US011795019B2

(12) United States Patent
Sakai

(10) Patent No.: US 11,795,019 B2
(45) **Date of Patent: *Oct. 24, 2023**

(54) SHEET CONVEYING DEVICE

(71) Applicant: TOSHIBA TEC KABUSHIKI KAISHA, Tokyo (JP)

(72) Inventor: Yasuhiro Sakai, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/881,656

(22) Filed: Aug. 5, 2022

(65) Prior Publication Data

US 2022/0371843 A1 Nov. 24, 2022

Related U.S. Application Data

(63) Continuation of application No. 17/193,142, filed on Mar. 5, 2021, now Pat. No. 11,440,761.

(51) Int. Cl.
*B65H 9/10* (2006.01)
*B65H 1/04* (2006.01)

(52) U.S. Cl.
CPC ..... *B65H 9/101* (2013.01); *B65H 1/04* (2013.01)

(58) Field of Classification Search
CPC ... B65H 1/04; B65H 1/12; B65H 1/22; B65H 3/24; B65H 3/247; B65H 9/101; B65H 2301/4223
USPC ..... 271/221, 271
See application file for complete search history.

(56) References Cited

U.S. PATENT DOCUMENTS

| | | | |
|---|---|---|---|
| 4,593,895 | A | 6/1986 | Myers et al. |
| 6,659,451 | B2 | 12/2003 | Kim |
| 7,007,948 | B2 | 3/2006 | Kamiya et al. |
| 7,942,399 | B2 | 5/2011 | Hirai et al. |
| 8,534,661 | B2 | 9/2013 | Hancock et al. |

(Continued)

FOREIGN PATENT DOCUMENTS

| | | | |
|---|---|---|---|
| JP | H05105243 A | * | 4/1993 |
| JP | 06-255801 | | 9/1994 |

(Continued)

OTHER PUBLICATIONS

Espacenet machine translation of JPH05105243A; http://translationportal.epo.org/emtp/translate/?ACTION=description-retrieval&COUNTRY=JP&ENGINE=google&FORMAT=docdb&KIND=A&LOCALE=en_EP&NUMBER=H05105243&OPS=ops.epo.org/3.2&SRCLANG=ja&TRGLANG=en (Year: 1993).*

(Continued)

*Primary Examiner* — Leslie A Nicholson, III
(74) *Attorney, Agent, or Firm* — AMIN, TUROCY & WATSON, LLP

(57) ABSTRACT

According to one embodiment, a sheet conveying device includes a tray and a correcting member. On the tray, a sheet bundle in which a plurality of sheets are overlapped is stacked in a thickness direction of the sheet bundle. The correcting member moves relative to the tray in the thickness direction. The correcting member abuts against an upper layer portion of an outer peripheral portion of the sheet bundle on the tray, and presses the upper layer portion from an outside after abutting. The correcting member corrects a position of the upper layer portion in a lateral direction intersecting the thickness direction toward an inside from the outside of the sheet bundle.

12 Claims, 13 Drawing Sheets

(56) References Cited

U.S. PATENT DOCUMENTS

| | | | |
|---|---|---|---|
| 8,941,849 | B2 | 1/2015 | Ohtsuka et al. |
| 9,908,725 | B2 | 3/2018 | Takanaga et al. |
| 10,889,456 | B2 | 1/2021 | Wick |

FOREIGN PATENT DOCUMENTS

| | | |
|---|---|---|
| JP | 2002-274661 | 9/2002 |
| JP | 2007-261790 | 10/2007 |

OTHER PUBLICATIONS

Non-Final Office Action for U.S. Appl. No. 17/193,142 dated Mar. 2, 2022.

* cited by examiner

SHEET CONVEYING DEVICE

CROSS-REFERENCE TO RELATED APPLICATIONS

This application is a Continuation of application Ser. No. 17/193,142 filed on Mar. 5, 2021, the entire contents of which are incorporated herein by reference.

FIELD

Embodiments described herein relate generally to a sheet conveying device, an image forming apparatus, and methods related thereto.

BACKGROUND

A sheet conveying device of an image forming apparatus accommodates a sheet bundle in which a plurality of sheets are overlapped. The sheet conveying device separates the uppermost sheet of the sheet bundle and then conveys the separated sheet one by one.

As the number of sheets increases and the sheet bundle becomes thicker, it becomes more difficult to align the outer peripheral portion of the sheet bundle and accommodate the sheet bundle in the sheet conveying device.

For example, when the position of the sheet in the width direction orthogonal to the conveying direction of the sheet varies, the sheet is conveyed in a state of being deviated in the width direction. When forming an image on a sheet, the image is undesirably deviated in the width direction.

For example, when the distal end of the sheet in the conveying direction is arranged with a large inclination, there is a possibility that a skew cannot be adjusted due to the resistance of the image forming apparatus.

DETAILED DESCRIPTION

A sheet conveying device of the embodiment includes a tray and a correcting member. On the tray, a sheet bundle in which a plurality of sheets are overlapped is stacked in a thickness direction of the sheet bundle. The correcting member moves relative to the tray in the thickness direction. The correcting member abuts against an upper layer portion of an outer peripheral portion of the sheet bundle on the tray, and presses the upper layer portion from an outside of the sheet bundle after abutting. The correcting member corrects a position of the upper layer portion in a lateral direction intersecting the thickness direction toward an inside from the outside of the sheet bundle. A sheet conveying method of another embodiment involves moving a correcting member relative to a tray for stacking a sheet bundle in which a plurality of sheets are overlapped in a thickness direction of the sheet bundle in the thickness direction; abutting the correcting member against an upper layer portion of an outer peripheral portion of the sheet bundle on the tray; pressing the upper layer portion from an outside of the sheet bundle by the correcting member; and correcting a position of the upper layer portion in a lateral direction intersecting the thickness direction toward an inside from the outside of the sheet bundle.

Embodiment

Hereinafter, the sheet conveying device according to an embodiment will be described with reference to the drawings.

Figure 1:
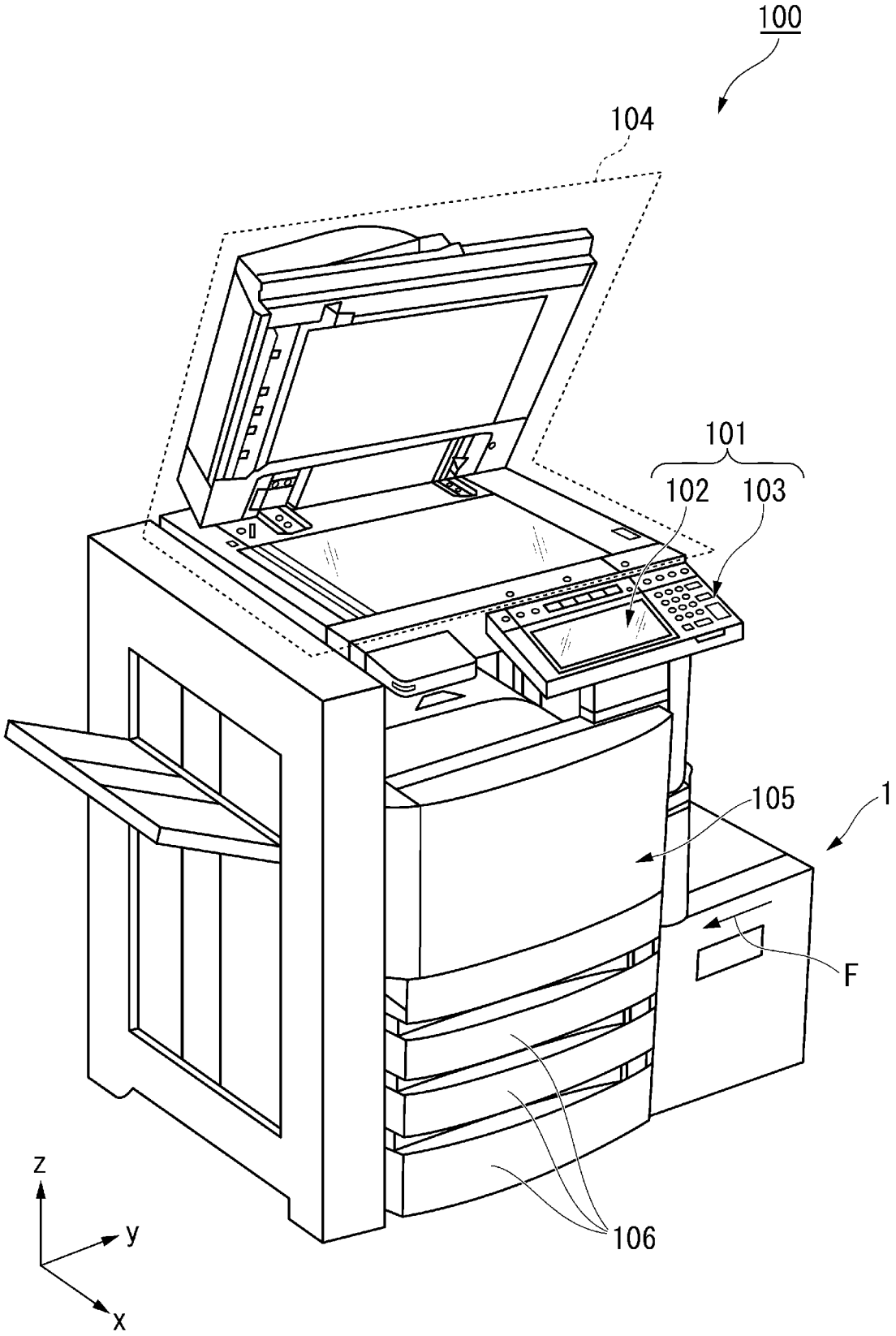
FIG. 1 is a schematic perspective view illustrating a configuration example of an image processing apparatus including a sheet conveying device according to an embodiment.

FIG. 1 is a schematic perspective view illustrating a configuration example of an image processing apparatus including the sheet conveying device according to the embodiment.

In each drawing, unless otherwise specified, the same reference numerals will be given to the same configurations (the same applies to the following drawings).

An image processing apparatus 100 illustrated in FIG. 1 is a multi-function peripheral (MFP). The image processing apparatus 100 includes an operation unit 101, a scanner unit 104, a printer unit 105, a cassette paper feed device 106, and a sheet conveying device 1 of the embodiment.

The image processing apparatus 100 forms an image on a sheet using a developer such as toner. The sheet used for the image processing apparatus 100 is, for example, a paper sheet, a label paper sheet, a resin sheet, a postcard, an envelope, or the like. As long as the image processing apparatus 100 can form an image on the surface of the sheet, the type of the sheet (paper sheet type) is not limited.

The image processing apparatus 100 may perform image processing on the sheet. For example, the image processing apparatus 100 may perform image processing for erasing the image on the sheet by applying heat to the sheet on which the image is formed with decolorable toner.

In the following, when referring to the relative position, the direction, and the like in the image processing apparatus 100, and when there is no concern of misunderstanding, words such as front, back, right, left, top, and bottom are used with the image processing apparatus 100 as the center. Right, left, top, and bottom indicate the right, left, top, and bottom of a person standing in front of the image processing apparatus 100 and looking backward.

Instead of front, back, right, left, top, bottom, there is a case where the xyz orthogonal coordinate system described in FIG. 1 is used. The xyz orthogonal coordinate system is a coordinate system fixed to the image processing apparatus 100.

The x-axis of the xyz orthogonal coordinate system is an axial line extending from the back to the front of the image processing apparatus 100 on the horizontal surface. The x-axis positive direction is the direction from the back to the front of the image processing apparatus 100. The x-axis negative direction is the direction opposite to the x-axis positive direction of the directions along the x-axis. The y-axis is an axial line extending from the left to the right of the image processing apparatus 100 on a horizontal surface when viewed from the front to the back of the image processing apparatus 100. The y-axis positive direction is the direction from the left to the right of the image processing apparatus 100. The y-axis negative direction is the direction opposite to the y-axis positive direction of the directions along the y-axis. The x-axis and the y-axis are orthogonal to each other. The z-axis is an axial line extending from the lower portion to the upper portion of the image processing apparatus 100. The z-axis is orthogonal to the x-axis and the y-axis. The z-axis positive direction is vertically upward. The z-axis negative direction is vertically downward.

The directions along each of the axial lines of the x-axis, the y-axis, and the z-axis are described as the x-axis direction, the y-axis direction, and the z-axis direction, respectively.

A plane having the x-axis and the y-axis is an xy plane. A plane having the y-axis and the z-axis is an yz plane. A plane having the z-axis and the x-axis is a zx plane.

Regarding the shape and the posture of each member of the image processing apparatus 100, unless otherwise specified, the shape and the posture in a state of being fixed to the image processing apparatus 100 will be described.

The operation unit 101 includes a display 102 and a control panel 103.

The display 102 is an image display device, such as a liquid crystal display or an organic electro luminescence (EL) display. The display 102 displays various pieces of information related to the image processing apparatus 100.

The control panel 103 includes a plurality of buttons. The control panel 103 receives an operation of the user. The control panel 103 outputs a signal that corresponds to an operation inputted by the user to the control unit of the image processing apparatus 100.

The display 102 and the control panel 103 may be configured as an integrated touch panel.

The scanner unit 104 reads image information which is a reading target based on brightness and darkness of light. The scanner unit 104 records the read image information. The recorded image information may be transmitted to another information processing apparatus via a network. The recorded image information may be formed on the sheet by the printer unit 105.

The printer unit 105 forms the image on the sheet based on the image information generated by the scanner unit 104 or the image information received via a communication path.

For example, the printer unit 105 includes an image forming unit, a fixing unit, and a paper discharge unit.

The image forming unit includes a photoreceptor drum, a charging unit, an exposure unit, a developing unit, an intermediate transfer belt, a primary transfer roller, and a secondary transfer roller.

The charging unit charges the photoreceptor drum. The exposure unit irradiates the photoreceptor drum with light to form an electrostatic latent image. The developing unit develops the electrostatic latent image by making toner adhere to the electrostatic latent image formed on the photoreceptor drum. The toner on the photoreceptor drum is transferred to the intermediate transfer belt by the primary transfer roller. The transferred toner is moved to the secondary transfer position by the intermediate transfer belt. The secondary transfer roller transfers the toner on the intermediate transfer belt to the sheet that reaches the secondary transfer position.

The toner used for image formation in the image processing apparatus 100 has one or more colors. When a plurality of colors are used as the toner, the photoreceptor drum, the charging unit, the exposure unit, the developing unit, and the primary transfer roller are respectively provided corresponding to the toners of each color.

The fixing unit fixes the toner image on the sheet by heating and pressurizing the toner image transferred onto the sheet.

For example, when a sheet on which an image is formed with decolorable toner is supplied, the fixing unit decolors the image of the decolorable toner by heating and pressurizing the image of the decolorable toner.

The paper discharge unit discharges a sheet on which the toner image is fixed by the fixing unit.

The cassette paper feed device 106 accommodates sheets used for image formation or image processing in the printer unit 105, in a cassette. The cassette paper feed device 106 conveys the sheets accommodated in the cassette to the printer unit 105.

The cassette paper feed device 106 may include a plurality of cassettes.

The outer shape of the sheet conveying device 1 is a rectangular parallelepiped. The sheet conveying device 1 is installed below the printer unit 105 and on the right side of the cassette paper feed device 106.

The sheet conveying device 1 accommodates a sheet bundle in which each of the multiple sheets is overlapped in the thickness direction, on the inside thereof. The sheet conveying device 1 conveys the sheet in a conveying direction F based on the operation from the operation unit 101, and supplies the sheet to the printer unit 105.

In the sheet conveying device 1, the direction in which the sheet is conveyed toward the printer unit 105 is the conveying direction F. When starting to convey the sheet, the conveying direction F is the y-axis negative direction. Unless otherwise specified, the conveying direction F is the direction when starting to convey the sheet.

Figure 2:
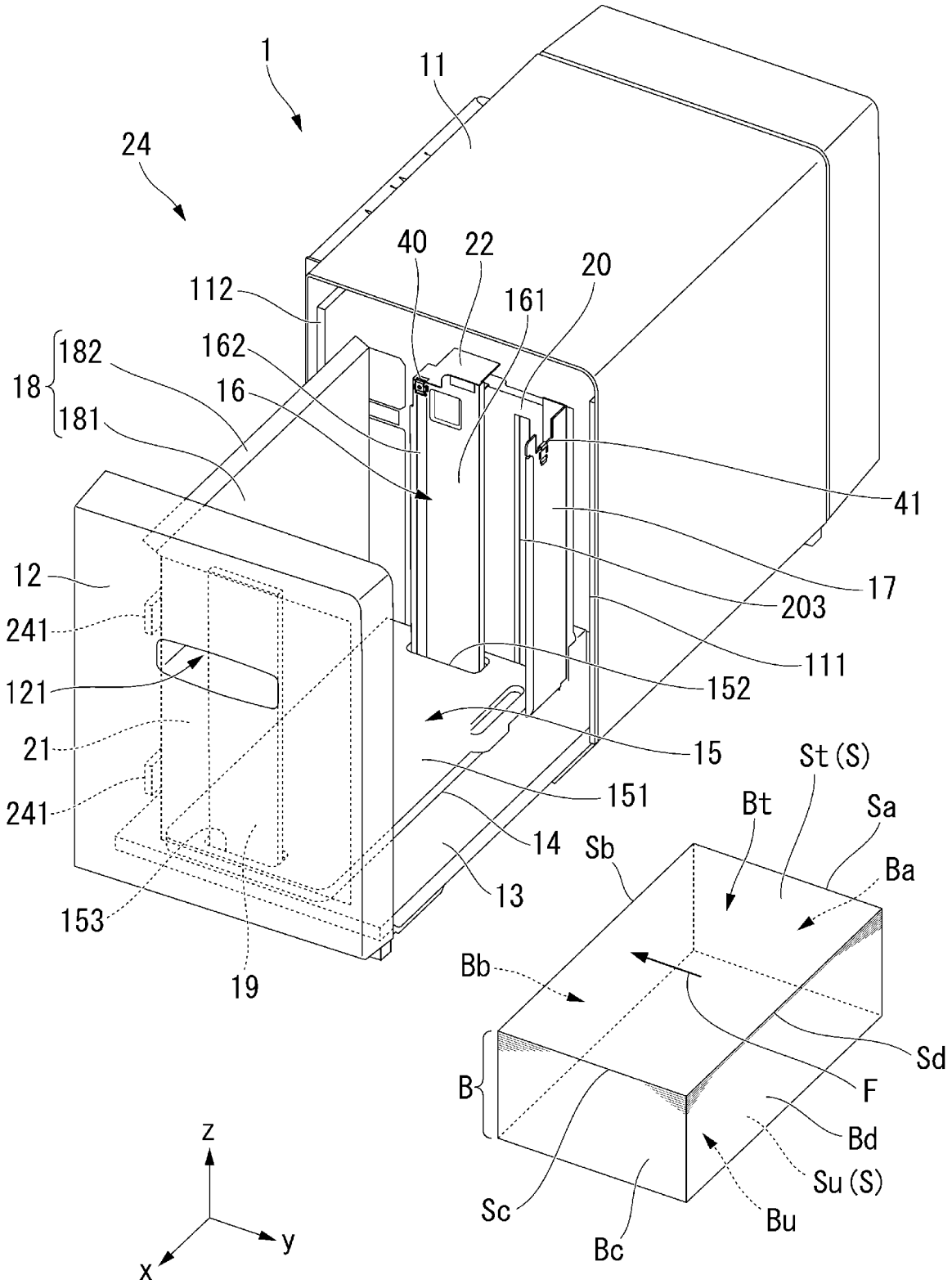
FIG. 2 is a schematic perspective view illustrating a configuration example of the sheet conveying device.

FIG. 2 is a schematic perspective view illustrating a configuration example of the sheet conveying device.

As illustrated in FIG. 2, the sheet conveying device 1 includes a housing 11, a front cover 12, and a bottom plate 13.

The housing 11 has a rectangular parallelepiped shape in which an opening is formed in the x-axis positive direction. A left frame 112 arranged parallel to the zx plane is provided close to the inner surface in the y-axis negative direction inside the housing 11. A right frame 111 arranged parallel to the zx plane is provided close to the inner surface in the y-axis positive direction inside the housing 11.

The lower ends of the left frame 112 and the right frame 111 are connected to each other by a lower frame parallel to the xy plane. The back ends of the left frame 112 and the right frame 111 are connected to each other by a back frame parallel to the yz plane.

The front cover 12 covers the opening of housing 11 such that the opening can be opened and closed. On the surface of the front cover 12 in the x-axis positive direction, a handle 121 for putting a hand when moving the front cover 12 in the x-axis direction is provided.

The bottom plate 13 is a plate member connected to the lower end portion of the front cover 12 and movable together with the front cover 12. The bottom plate 13 has a plate shape parallel to the xy plane.

A rising and falling frame 14, a tray 15, a first guide member 19, a front side plate 21, a second guide member 18, a back side plate 20, and support members 16 and 17 are provided on the bottom plate 13.

The rising and falling frame 14 is provided on the bottom plate 13 to be movable in the z-axis direction.

The tray 15 is fixed on the rising and falling frame 14 and can move in the z-axis direction together with the rising and falling frame 14.

The tray 15 has an upper surface 151 on which a sheet bundle B is stacked. The upper surface 151 includes an area wider than an area of the sheet bundle B in a plane view seen in the z-axis negative direction. The upper surface 151 is parallel to the xy plane.

In FIG. 2, the sheet bundle B before being stacked on the tray 15 is drawn.

Sheets S included in the sheet bundle B have a rectangle shape having long sides Sb and Sd opposing each other and short sides Sa and Sc opposing each other.

The sheet bundle B has a rectangular parallelepiped shape as a whole in which the plurality of sheets S having a rectangular shape in a plane view are overlapped in the thickness direction of the sheets S. In particular, immediately after the sheet bundle B is carefully taken out from the wrapping paper, the outer peripheral portions Ba, Bb, Bc, and Bd of the sheet bundle B are all aligned on a plane orthogonal to the thickness direction.

The posture when the sheet bundle B is stacked on the tray 15 is a posture in which the long sides Sb of each sheet S face in the y-axis negative direction and the short sides Sa face in the x-axis negative direction.

Since the upper surface 151 of the tray 15 is parallel to the xy plane, the thickness direction of the sheet S stacked on the upper surface 151 matches the z-axis direction.

In the outer peripheral portion Ba of the sheet bundle B in the x-axis negative direction, the short sides Sa of each sheet S are aligned and arranged in the thickness direction of the sheet S. In the outer peripheral portion Bb of the sheet bundle B in the y-axis negative direction, the long sides Sb of each sheet S are aligned and arranged in the thickness direction of the sheet S. In the outer peripheral portion Bc of the sheet bundle B in the x-axis positive direction, the short sides Sc of each sheet S are aligned and arranged in the thickness direction of the sheet S. In the outer peripheral portion Bd of the sheet bundle B in the y-axis positive direction, the long sides Sd of each sheet S are aligned and arranged in the thickness direction of the sheet S.

However, before the sheet bundle B is stacked on the tray 15, there is a possibility that the relative positions of the sheets S in the sheet bundle B are deviated, and unevenness occurs in the outer peripheral portions Ba, Bb, Bc, and Bd.

On an uppermost surface Bt of the sheet bundle B, there is a sheet St. On a lowermost surface Bu of the sheet bundle B, there is a sheet Su.

The first guide member 19 is at the end portion inner than the end of the bottom plate 13 in the x-axis positive direction, and extends in the z-axis positive direction from the part inner than the end of the tray 15 in the x-axis positive direction. The first guide member 19 is inserted through a through hole 153 formed on the tray 15.

The first guide member 19 regulates the position of the outer peripheral portion Bc in the x-axis positive direction as the outer peripheral portion Bc of the sheet bundle B abuts against the first guide member 19.

The shape of the first guide member 19 is not particularly limited as long as it is possible to abut against the outer peripheral portion Bc and align the outer peripheral portion Bc parallel to the yz plane. For example, the first guide member 19 may be a flat plate parallel to the yz plane. The first guide member 19 may include a plurality of ridges extending in the z-axis direction on the surface of the flat plate parallel to the yz plane in the z-axis positive direction.

Figure 3:
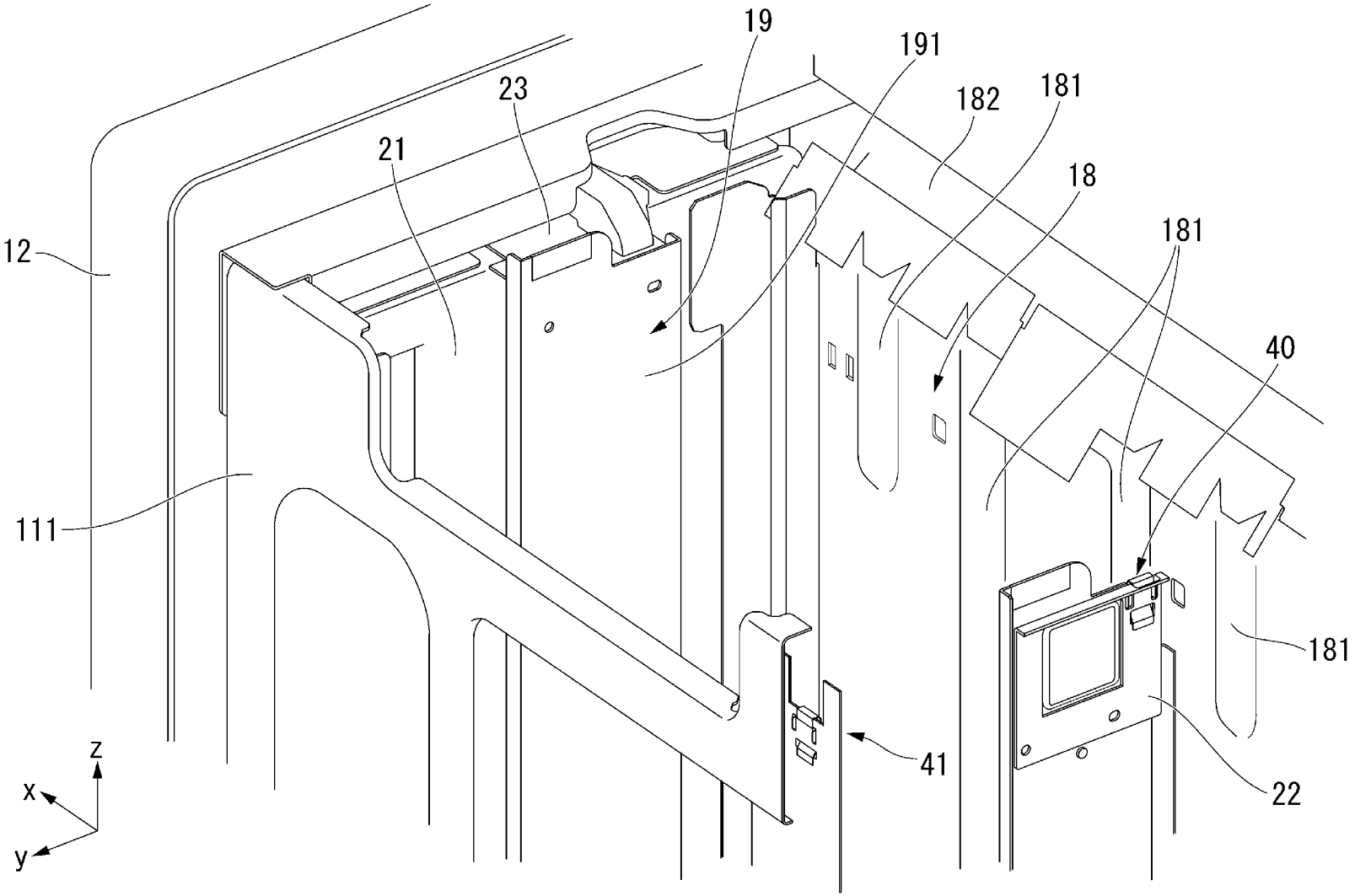
FIG. 3 is a schematic perspective view illustrating an inner configuration of a front side and a left side of the sheet conveying device.

FIG. 3 is a schematic perspective view illustrating an inner configuration of the front side and the left side of the sheet conveying device.

In the example illustrated in FIG. 3, the first guide member 19 includes a flat surface portion 191 parallel to the yz plane capable of abutting against the outer peripheral portion Bc.

The width of the first guide member 19 in the y-axis direction is shorter than the length of the short side Sc of the sheet S. The height of the first guide member 19 from the bottom plate 13 in the z-axis direction is higher than the position where the upper surface 151 of the tray 15 is most raised.

The arrangement position of the first guide member 19 in the y-axis direction is more preferably the center of the tray 15 in the y-axis direction.

The upper end portion of the first guide member 19 is fixed to the fixing member 23 fixed to the upper end of the front side plate 21.

As illustrated in FIG. 2, the front side plate 21 is at the end portion of the bottom plate 13 inner than the end of the bottom plate 13 in the x-axis positive direction, and extends in the z-axis positive direction from the part outer than the end of the tray 15 in the x-axis positive direction.

The second guide member 18 is at the end portion of the bottom plate 13 inner than the end of the bottom plate 13 in the y-axis negative direction, and extends in the z-axis positive direction from the part outer than the end of the tray 15 in the y-axis negative direction.

The second guide member 18 regulates the position of the outer peripheral portion Bb in the y-axis negative direction as the outer peripheral portion Bb of the sheet bundle B abuts against the second guide member 18.

The shape of the second guide member 18 is not particularly limited as long as it is possible to abut against the outer peripheral portion Bb and align the outer peripheral portion Bb parallel to the zx plane. For example, the second guide member 18 may be a flat plate parallel to the zx plane. The second guide member 18 may include a plurality of ridges extending in the z-axis direction on the surface of the flat plate parallel to the zx plane in the y-axis positive direction.

In the embodiment, the second guide member 18 includes a flat surface portion 181 parallel to the zx plane capable of abutting against the outer peripheral portion Bc.

The width of the second guide member 18 in the x-axis direction is longer than the length of the long side Sb of the sheet S and the width of the tray 15 in the x-axis direction. The flat surface portion 181 of the second guide member 18 can abut against a center portion of the long side Sb and both end portions in the x-axis direction, in at least the upper end portion of the outer peripheral portion Bc of the sheet bundle B stacked on the tray 15.

The height of the flat surface portion 181 of the second guide member 18 from the bottom plate 13 in the z-axis direction is approximately the same as the position where the upper surface 151 is the most raised.

As illustrated in FIG. 2, at the end of the flat surface portion 181 in the z-axis positive direction, a conveying guide portion 182 inclined in the y-axis negative direction as advancing in the z-axis positive direction is provided.

The conveying guide portion 182 guides the direction of the uppermost sheet St of the sheet bundle B conveyed in the conveying direction F diagonally upward.

The end of the second guide member 18 in the x-axis positive direction is connected to the end of the front side plate 21 in the y-axis negative direction.

The back side plate 20 extends in the z-axis positive direction from the end portion of the bottom plate 13 in the x-axis negative direction more than the end of the tray 15 in the x-axis negative direction.

The end of the back side plate 20 in the y-axis negative direction is connected to the end of the second guide member 18 in the x-axis negative direction.

On the back side plate 20, a slit 203 having a length in the z-axis direction and penetrating the back side plate 20 in the thickness direction is formed. The number of slits 203 may be one or more. In the embodiment, the slits 203 are formed at two locations across the support member 16 when viewed in the x-axis negative direction.

The support member 16 is at the end portion inner than the end of the bottom plate 13 in the x-axis negative direction, protrudes in the z-axis positive direction from the part inner than the end of the tray 15 in the x-axis negative direction, and has a length in the x-axis direction. The support member 16 is inserted through a through hole 152 formed in the tray 15.

The support member 16 regulates the position of the outer peripheral portion Ba of the sheet bundle B in the x-axis negative direction, in the x-axis negative direction.

The shape of the support member 16 is not particularly limited as long as the position of the outer peripheral portion Ba can be regulated along the plane parallel to the yz plane. For example, the support member 16 may be a flat plate parallel to the yz plane. The support member 16 may include a plurality of ridges extending in the z-axis direction on the surface of the flat plate parallel to the yz plane in the z-axis positive direction.

In the embodiment, the support member 16 includes a flat plate portion 161 parallel to the yz plane, and has a channel shape having both end portions of the flat plate portion in the y-axis direction bent in the x-axis negative direction and having a length in the z-axis direction.

The support member 16 includes a flat surface portion 162 which protrudes from the surface of the flat plate portion 161 in the x-axis positive direction and has a stepped shape elongated in the z-axis direction.

The flat surface portion 162 has a flat surface parallel to the yz plane that can abut against the outer peripheral portion Ba. The width of the flat surface portion 162 in the y-axis direction is narrower than the width of the flat plate portion 161. The flat surface portion 162 is provided close the end of the flat plate portion 161 in the y-axis negative direction.

The flat surface portion 162 is an example of an abutment portion capable of abutting the outer peripheral portion of the sheet bundle and aligning the positions of the outer peripheral portions in the lateral direction. Here, the lateral direction is the x-axis positive direction.

It is more preferable that the flat surface portion 162 is arranged at a position where it is possible to abut against the intermediate portion of the outer peripheral portion Ba in the y-axis direction.

The width of the support member 16 in the y-axis direction is shorter than the length of the short side Sa of the sheet S. For example, the width of the support member 16 in the y-axis direction may be equal to the width of the first guide member 19 in the y-axis direction.

The height of the support member 16 from the bottom plate 13 in the z-axis direction is higher than the position where the upper surface 151 of the tray 15 is most raised.

The arrangement position of the support member 16 in the y-axis direction is a position opposing the first guide member 19 in the x-axis direction.

The distance between the flat surface portion 162 of the support member 16 and the flat surface portion 191 of the first guide member 19 in the x-axis direction is longer than the lengths of the long sides Sb and Sd of the sheet S.

The upper end portion of the support member 16 is fixed to the fixing member 22 fixed to the upper end of the back side plate 20.

The support member 17 is at the end portion of the bottom plate 13 inner than the end of the bottom plate 13 in the y-axis positive direction, and extends in the z-axis positive direction from the part outer than the end of the tray 15 in the y-axis positive direction. The support member 17 opposes the second guide member 18. The end of the support member 17 in the x-axis negative direction is connected to the end of the back side plate 20 in the y-axis positive direction.

The support member 17 regulates the position of the outer peripheral portion Bd of the sheet bundle B in the y-axis positive direction.

The shape of the support member 17 is not particularly limited as long as the position of the outer peripheral portion Bd can be regulated along the plane parallel to the yz plane. The support member 17 may be a flat plate parallel to the zx plane. The support member 17 may include a plurality of ridges extending in the z-axis direction on the surface of the flat plate parallel to the zx plane in the y-axis negative direction.

Figure 4:
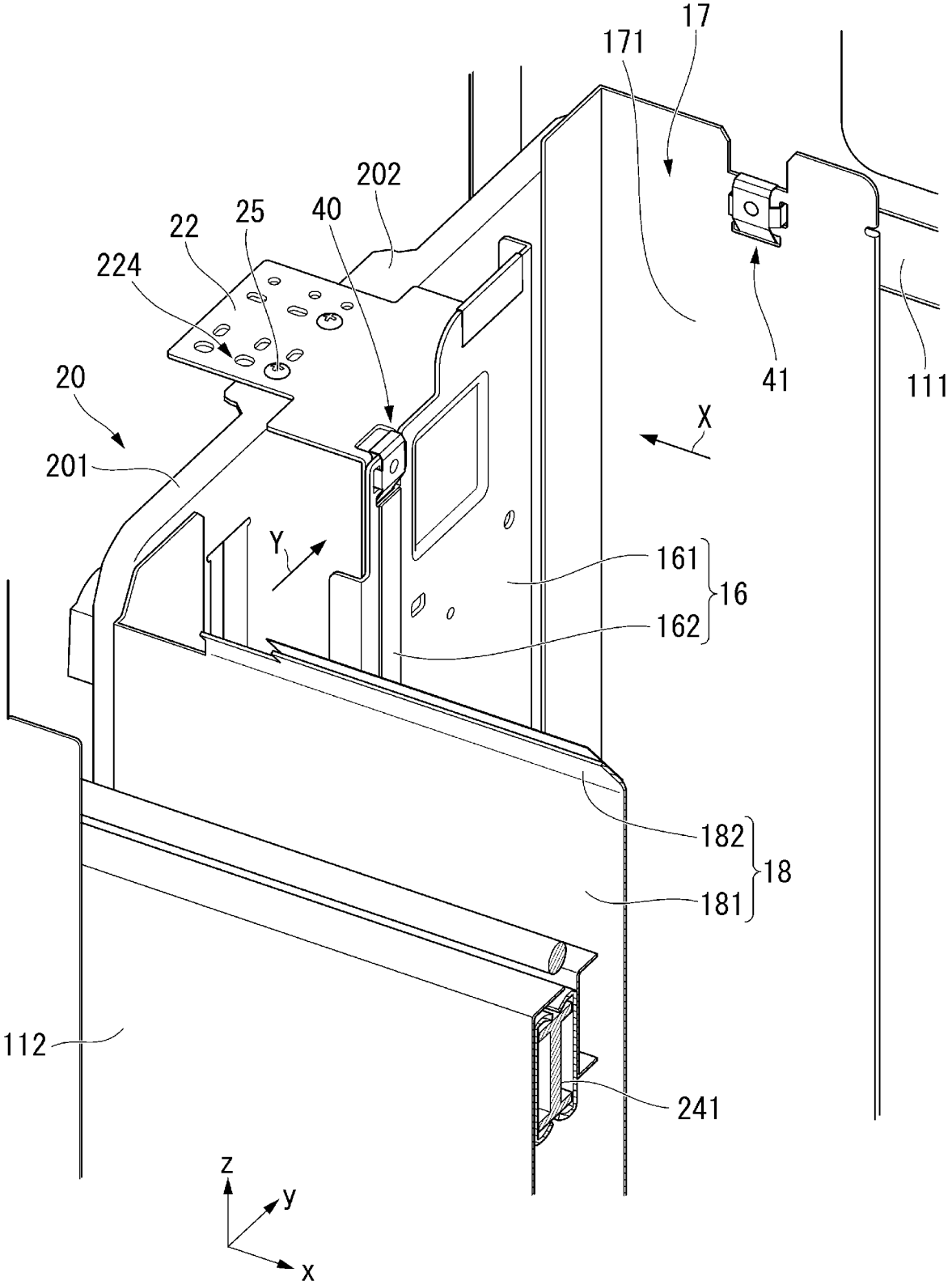
FIG. 4 is a schematic perspective view illustrating an inner configuration of a back side of the sheet conveying device.

FIG. 4 is a schematic perspective view illustrating an inner configuration of the back side of the sheet conveying device.

In the example illustrated in FIG. 4, the support member 17 includes a flat surface portion 171 parallel to the yz plane capable of abutting against the outer peripheral portion Bd.

Here, the flat surface portion 171 is an example of an abutment portion capable of abutting the outer peripheral portion of the sheet bundle and aligning the positions of the outer peripheral portions in the lateral direction. Here, the lateral direction is the y-axis positive direction.

The distance between the flat surface portion 171 of the support member 17 and the flat surface portion 181 of the second guide member 18 in the y-axis direction is longer than the lengths of the short sides Sa and Sc of the sheet S.

The width of the support member 17 in the x-axis direction is shorter than the length of the long side Sd of the sheet S and the width of the tray 15 in the x-axis direction.

The height of the flat surface portion 171 of the support member 17 from the bottom plate 13 in the z-axis direction is higher than the position where the upper surface 151 of the tray 15 is most raised.

The front side plate 21, the second guide member 18, the back side plate 20, and the support member 17 are frames that surround the tray 15 along the peripheral edges in the x-axis positive direction, the y-axis negative direction, the x-axis negative direction, and the y-axis positive direction of the tray 15 in a plane view.

When the sheet bundle B is stacked on the upper surface 151 of the tray 15, the arrangement position of the sheet bundle B in the x-axis direction is regulated within the range between the first guide member 19 and the support member 16. Similarly, the arrangement position of the sheet bundle B in the y-axis direction is regulated within the range between the second guide member 18 and the support member 17.

As illustrated in FIG. 2, the front cover 12 and the bottom plate 13 of the sheet conveying device 1 are fixed to each other, and configure a drawer portion 24 that can be drawn out to the front side of the housing 11 together with a member directly or indirectly fixed on the bottom plate 13.

The drawer portion 24 is connected to the left frame 112 to be relatively movable by a slide rail 241 that can be slidably moved in the x-axis direction.

FIG. 2 illustrates a drawn state where the slide rail 241 is the most extended. In the drawn state, the tray 15 in the drawer portion 24 and the frame that surrounds the tray 15 protrude in the x-axis positive direction from the opening of the housing 11. In the drawer state, the user can stack the sheet bundle B on the tray 15 from above the tray 15.

Figure 5:
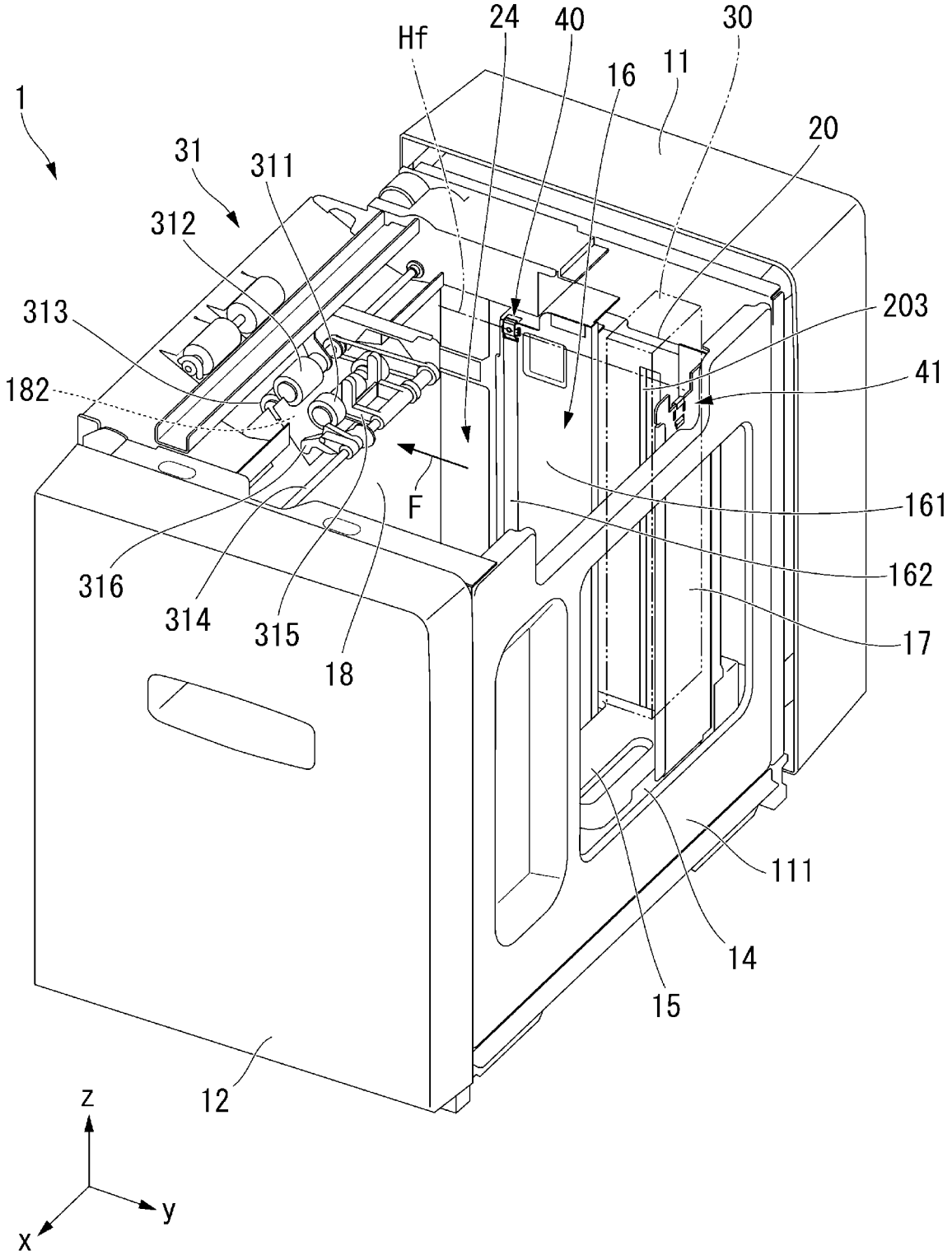
FIG. 5 is a schematic perspective view illustrating an inner configuration of the sheet conveying device.

FIG. 5 is a schematic perspective view illustrating an inner configuration of the sheet conveying device. In FIG. 5, the inside of the housing 11 in an accommodated state where the slide rail 241 (refer to FIG. 2) is shortened and the drawer portion 24 is accommodated inside the housing 11, is illustrated. In FIG. 5, in order to illustrate the inside of the housing 11, the illustration of the cover that covers the upper side and the right side is omitted.

Above the second guide member 18 in the accommodated state, there is a paper feed mechanism 31.

The paper feed mechanism 31 separates the sheet St from the upper side of the sheet bundle B stacked on the tray 15 and feeds the sheet St to the printer unit 105.

For example, the paper feed mechanism 31 includes a sheet detection sensor 316, a pickup roller 311, a paper feed roller 312, and a separation roller 313.

The sheet detection sensor 316 detects whether the sheet S is rising to a paper feed position Hf where the paper feeding is started by the paper feed mechanism 31. For example, the sheet detection sensor 316 includes a detection plate that abuts against the sheet St from above, and a sensor such as a photo interrupter that generates a detection signal when the height of the detection plate reaches the height of the paper feed position Hf.

The pickup roller 311 is supported by a holder 315 that is rotatable around a shaft 314 having a length in the x-axis direction. The pickup roller 311 abuts against the uppermost sheet S of the sheet bundle B by the rotation of the holder 315. The pickup roller 311 rotates in conjunction with the paper feed roller 312 to move the sheet S to the conveying direction F which is the y-axis negative direction.

The paper feed roller 312 receives a driving force from the drive motor to rotate, and moves the sheet S that moves along the conveying guide portion 182 in the diagonal direction facing in the z-axis positive direction as advancing in the y-axis negative direction. A drive transmission mechanism is provided between the paper feed roller 312 and the pickup roller 311, and the pickup roller 311 rotates in the same direction as the paper feed roller 312.

The separation roller 313 abuts against the paper feed roller 312 under the paper feed roller 312. A torque limiter is built in the separation roller 313. The separation roller 313 separates only the sheet St from the sheets S that move between the paper feed roller 312 and the separation roller 313 based on the difference between the frictional force with the paper feed roller 312, the frictional force with the sheet S, and the frictional force between the sheets S.

As illustrated by the two-dot chain line in FIG. 5, behind the back side plate 20 in the drawer portion 24, a raising and lowering mechanism 30 for moving the rising and falling frame 14 in the z-axis direction is provided.

The raising and lowering mechanism 30 is provided between the support member 16 and the slit 203 when viewed in the x-axis negative direction.

The configuration of the raising and lowering mechanism 30 is not particularly limited as long as the rising and falling frame 14 can be raised and lowered in the z-axis direction. An example of the raising and lowering mechanism 30 will be described with reference to FIG. 6.

Figure 6:
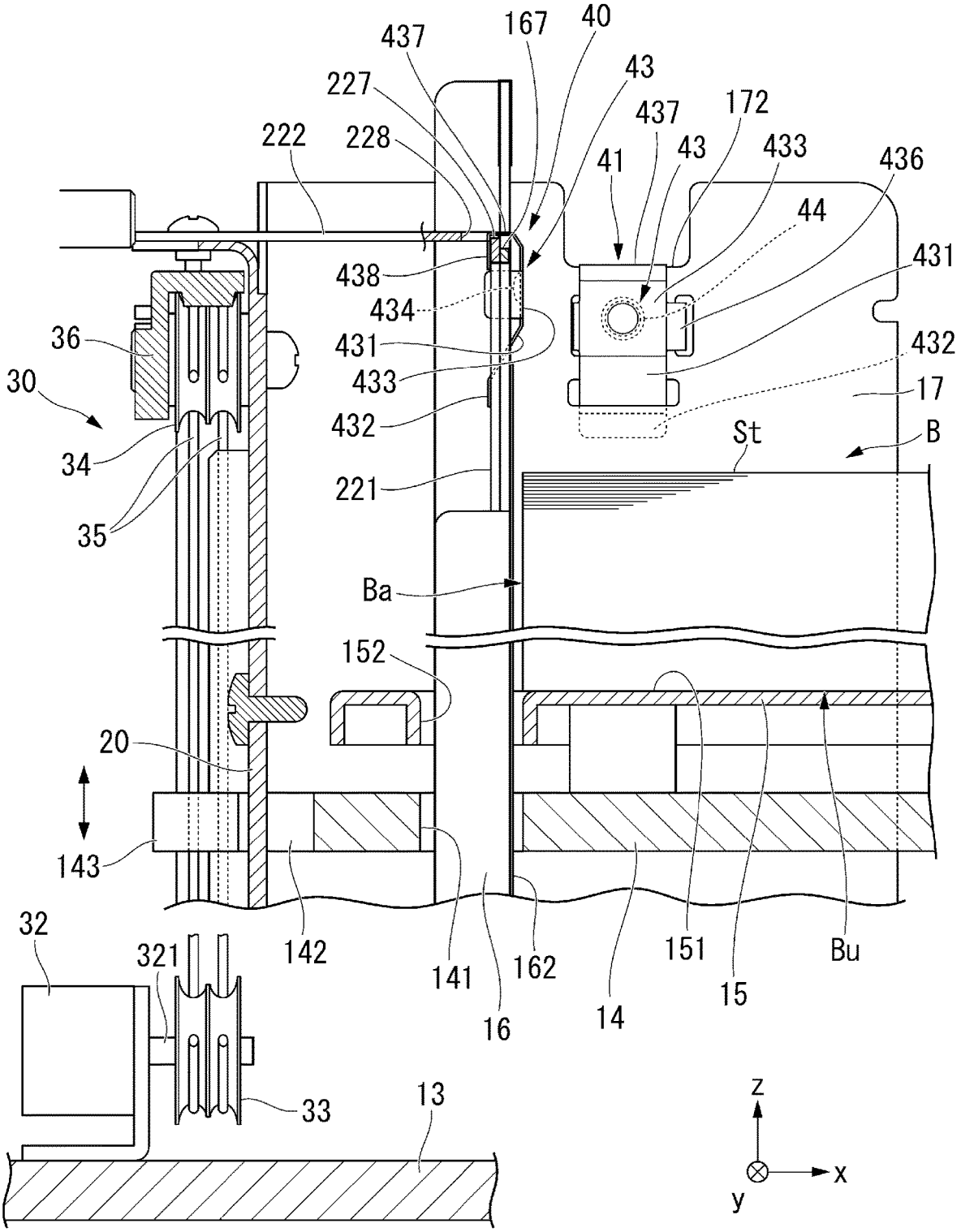
FIG. 6 is a schematic view seen in a direction of an arrow Y in FIG. 4.

FIG. 6 is a schematic view seen in the direction of the arrow Y in FIG. 4.

As illustrated in FIG. 6, the raising and lowering mechanism 30 includes a drive motor 32, a first pulley 33, a second pulley 34, and a wire 35.

The drive motor 32 supplies a driving force for raising and lowering the rising and falling frame 14. The drive motor 32 is fixed to the bottom plate 13 via a fixture.

The first pulley 33 is fixed to an output shaft 321 of the drive motor 32.

The second pulley 34 is rotatably held by a pulley holder 36. The second pulley 34 is fixed to the surface of the upper end portion of the back side plate 20 in the y-axis negative direction.

The wire 35 is wound around the first pulley 33 and the second pulley 34 and stretched long in the z-axis direction.

When the drive motor 32 rotates, the wire 35 moves between the first pulley 33 and the second pulley 34 in the z-axis positive direction or the z-axis negative direction.

The rising and falling frame 14 includes a support member 16 inserted through a through hole 141 formed to oppose the through hole 152 in the z-axis direction, and is held horizontally on the back side plate 20 to be movable in the z-axis direction. The mechanism for holding the rising and falling frame 14 on the back side plate 20 is not particularly limited. For example, the rising and falling frame 14 may include a roller that sandwiches the back side plate 20 in the thickness direction and may be fixed to a movable holder that can move in the z-axis direction.

An arm 142 protrudes in the x-axis negative direction at the end portion of the rising and falling frame 14 in the y-axis positive direction. The arm 142 is inserted into the slit 203 (refer to FIG. 5) of the back side plate 20.

The end portion of the arm 142 in the x-axis negative direction is fixed to the wire 35 by the fixing unit 143 and can move in the z-axis direction in conjunction with the wire 35.

As illustrated in FIG. 2, in the upper end portions of the support members 16 and 17, a first correcting member 40 and a second correcting member 41 are provided, respectively.

The first correcting member 40 presses the upper layer portion of the outer peripheral portion Ba of the sheet bundle B that rises together with the tray 15 in the x-axis positive direction, and corrects the position of the outer peripheral portion Ba in the x-axis direction.

The second correcting member 41 presses the upper layer portion of the outer peripheral portion Bc of the sheet bundle B that rises together with the tray 15 in the y-axis negative direction, and corrects the position of the outer peripheral portion Bc in the y-axis direction.

The first correcting member 40 and the second correcting member 41 have the same configuration except that the installation place is different.

The first correcting member 40 will be described.

As illustrated in FIG. 4, the position of the first correcting member 40 in the z-axis direction and the y-axis direction is fixed in the upper end portion of the support member 16. The first correcting member 40 protrudes in the x-axis positive direction from the flat plate portion 161 of the support member 16.

The position of the first correcting member 40 in the y-axis direction is not particularly limited, and in the example illustrated in FIG. 4, the first correcting member 40 is adjacent to the upper end portion of the flat surface portion 162. Similar to the flat surface portion 162, the first correcting member 40 is arranged at a position where it is possible to abut against the intermediate portion of the outer peripheral portion Ba in the y-axis direction.

Figure 7:
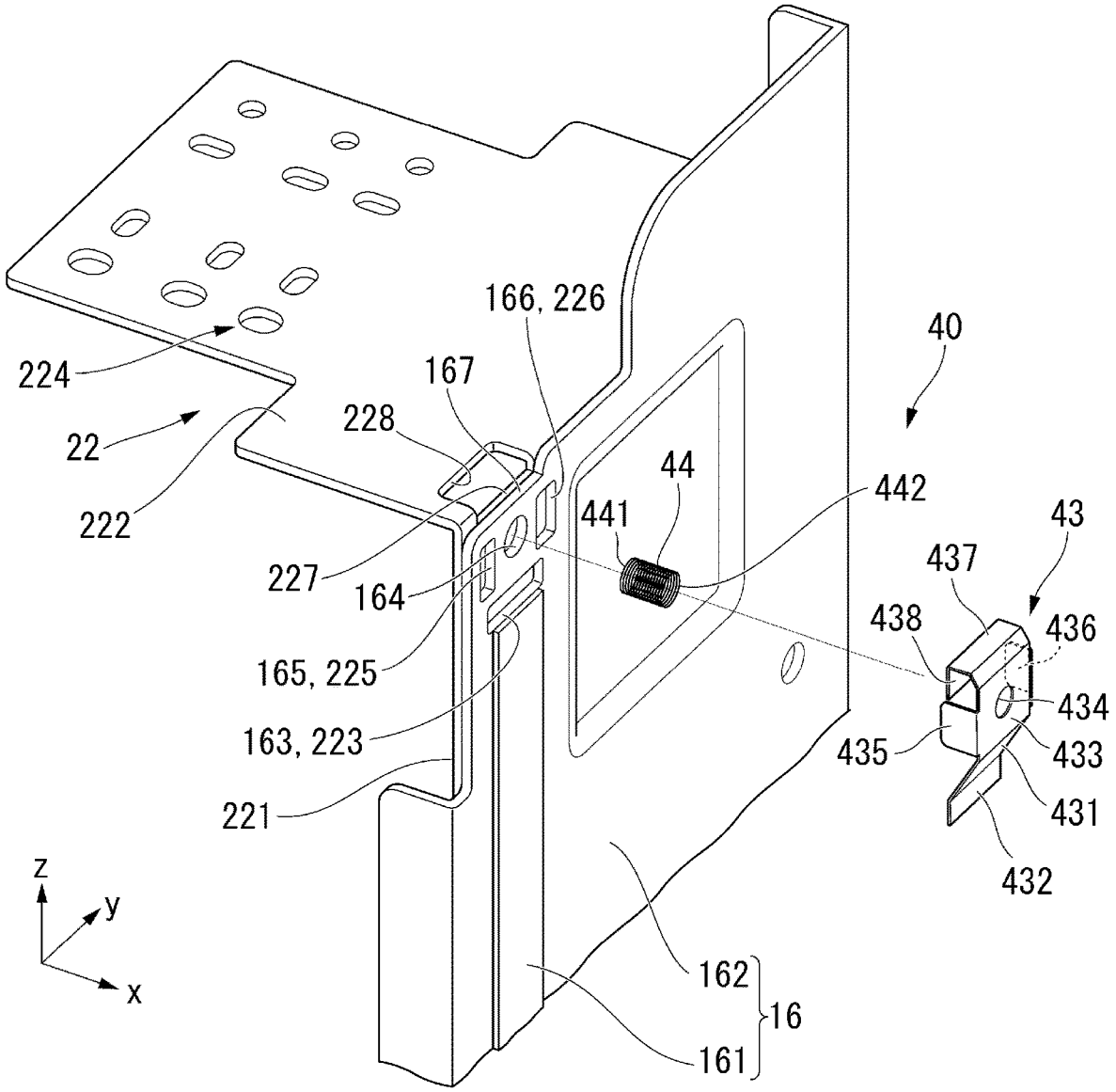
FIG. 7 is a schematic exploded perspective view of a correction mechanism in the sheet conveying device.
Figure 8:
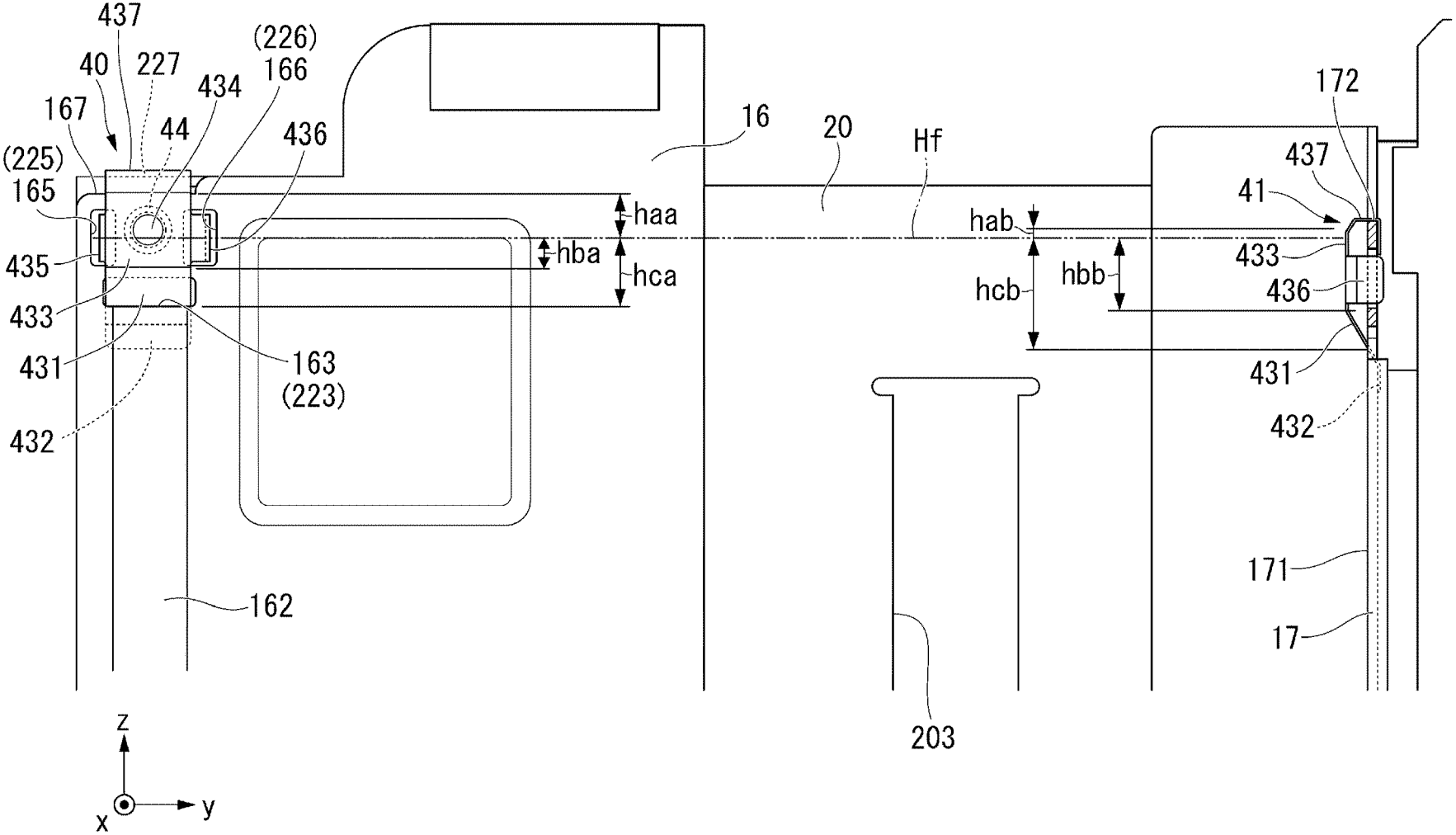
FIG. 8 is a schematic view seen in a direction of an arrow X in FIG. 4.

FIG. 7 is a schematic exploded perspective view of a correction mechanism in the sheet conveying device. FIG. 8 is a schematic view seen in the direction of the arrow X in FIG. 4.

As illustrated in FIG. 7, the first correcting member 40 includes a main body portion 43 and a biasing member 44.

The main body portion 43 includes a first pressing unit 431, a first locking unit 432, a second pressing unit 433, a projection portion 434, side plate portions 435 and 436, an upper surface portion 437, and a second locking unit 438.

The first pressing unit 431 is a flat plate that inclines in the x-axis positive direction as advancing in the z-axis positive direction with respect to the yz plane.

The first locking unit 432 is a flat plate parallel to the yz plane that protrudes from the end of the first pressing unit 431 in the z-axis negative direction, in the z-axis negative direction.

As illustrated in FIG. 8, the width of the first locking unit 432 in the y-axis direction is substantially equal to the width of the first pressing unit 431 in the y-axis direction. The length of the first locking unit 432 in the z-axis direction is shorter than the width in the y-axis direction.

As illustrated in FIG. 7, the second pressing unit 433 is a flat plate parallel to the yz plane that protrudes from the end of the first pressing unit 431 in the z-axis positive direction, in the z-axis positive direction.

As illustrated in FIG. 8, the outer shape of the second pressing unit 433 when viewed in the x-axis negative direction is a square or a rectangle close to a square.

As illustrated in FIG. 6, the second pressing unit 433 is a projection portion that protrudes in the x-axis negative direction from the center portion of the second pressing unit 433. The protruding shape of the second pressing unit 433 is not particularly limited as long as it is possible to prevent the deviation of the biasing member 44 that presses the second pressing unit 433 in the x-axis positive direction, in the z-axis direction and the y-axis direction.

In the example illustrated in FIG. 6, the second pressing unit 433 has a hemispherical shape that protrudes in the x-axis negative direction.

As illustrated in FIG. 7, the side plate portion 435 is a flat plate that protrudes in the x-axis negative direction from the side edge of the second pressing unit 433 in the y-axis negative direction. The side plate portion 435 is bent in the x-axis negative direction at the end of the second pressing unit 433 in the y-axis negative direction.

The side plate portion 436 is a bent plate that protrudes in the x-axis negative direction as a whole from the side edge of the second pressing unit 433 in the y-axis positive direction.

As illustrated in FIG. 8, the side plate portion 436 is bent in the diagonal direction facing in the x-axis negative direction as advancing in the y-axis positive direction, and then is bent in the x-axis negative direction, at the end of the second pressing unit 433 in the y-axis positive direction.

As illustrated in FIGS. 6 and 7, the upper surface portion 437 is a bent plate which is bent in the diagonal direction facing in the z-axis positive direction as advancing in the x-axis negative direction, and then is bent in the x-axis negative direction, at the end of the second pressing unit 433 in the z-axis positive direction.

As illustrated in FIG. 6, the position of the upper surface portion 437 in the x-axis direction is the same as the position of the end of the first pressing unit 431 in the z-axis negative direction in the x-axis direction when viewed in the y-axis negative direction.

As illustrated in FIG. 7, the second locking unit 438 is a flat plate that is bent in the z-axis negative direction from the end of the upper surface portion 437 in the x-axis negative direction.

As illustrated in FIG. 8, the position of the second locking unit 438 in the x-axis direction is the same as the position of the first locking unit 432 in the x-axis direction.

The main body portion 43 can be formed by pressing a plate material having a smooth surface, such as stainless steel.

As illustrated in FIG. 7, the main body portion 43 is locked to the support member 16 and the fixing member 22 across the biasing member 44 between the main body portion 43 and the fixing member 22 of the support member 16.

The configuration of the biasing member 44 is not particularly limited as long as it is possible to be locked to the fixing member 22 and bias the second pressing unit 433 in the x-axis positive direction. For example, the biasing member 44 may be an elastic body such as a compression coil spring, a plate spring, or an elastomer.

In the example illustrated in FIG. 7, the biasing member 44 is a compression coil spring of which the natural length is longer than the distance between the surface of the fixing member 22 in the x-axis positive direction and the surface of the second pressing unit 433 in the x-axis negative direction.

A first end portion 441 of the biasing member 44 in the x-axis negative direction is locked to the fixing member 22 in the x-axis negative direction.

A second end portion 442 of the biasing member 44 in the x-axis positive direction presses the second pressing unit 433 in the x-axis positive direction. In a state where the second end portion 442 is the second pressing unit 433, the projection portion 434 enters the inside of the second end portion 442.

Opening portions 163, 164, 165, and 166 penetrate in the thickness direction in the upper end portion of the support member 16 to which the first correcting member 40 is attached.

The opening portion 163 is a rectangular hole having a size that makes it possible for the first locking unit 432 and the first pressing unit 431 to be inserted and is long in the y-axis direction. The opening portion 163 has a size that makes it possible for the first locking unit 432 to translate within the opening portion 163 in the x-axis direction when the second pressing unit 433 moves in the x-axis direction.

The opening portions 164 and 165 are rectangular holes having a size that makes it possible for the side plate portions 435 and 436 to be inserted and are long in the z-axis direction, respectively.

The opening portion 166 is a circular hole through which the first end portion 441 of the biasing member 44 can be inserted. The opening portion 166 regulates the position of the first end portion 441 in the y-axis direction and the z-axis direction.

The fixing member 22 fixed to the upper end portion of the support member 16 includes a first plate portion 221 fixed to the surface of the support member 16 in the x-axis negative direction, and a second plate portion 222 which is a flat plate bent in the x-axis negative direction from the end of the first plate portion 221 in the z-axis positive direction and is parallel to the xy plane.

In the first plate portion 221, at the position where the opening portions 163, 165, and 166 are overlapped when viewed in the x-axis negative direction, the opening portions 223, 225, and 226 having the same shape as the opening portions 163, 165, and 166 penetrate in the thickness direction.

Similar to the opening portion 163, the opening portion 223 is an example of an opening portion through which the first pressing unit is inserted to be translatable in the lateral direction.

The first plate portion 221 closes the opening portion 164 at a position where the opening portion 164 overlaps when viewed in the x-axis negative direction. The first end portion 441 of the biasing member 44 inserted into the opening portion 164 is locked to the first plate portion 221 facing the opening portion 164.

A plurality of screw holes 224 and an opening portion 228 penetrate through the second plate portion 222 in the thickness direction.

As illustrated in FIG. 4, through the plurality of screw holes 224, a screw 25 to be screwed to the upper surface portion 201 of the back side plate 20 is inserted. A plurality of screw holes 224 are formed apart from each other in the x-axis direction such that the position of the support member 16 in the x-axis direction with respect to the back side plate 20 can be changed in a plurality of steps.

As illustrated in FIG. 7, the opening portion 228 is opened adjacent to the first plate portion 221. The hole shape of the opening portion 228 viewed in the z-axis negative direction is a rectangle into which the second locking unit 438 can be inserted.

At the inner edge of the opening portion 228 in the x-axis positive direction, there is a first plate portion 221.

As illustrated in FIG. 6 with a partial breakage, a locking unit 227 is formed at the upper end of the first plate portion 221 that forms the inner edge of the opening portion 228. The locking unit 227 is above the upper end 167 adjacent to the opening portion 228 in the support member 16.

In the attached state of the main body portion 43 illustrated in FIG. 8, the side plate portions 435 and 436 and the first pressing unit 431 are inserted into the opening portions 165 (225), 166 (226), and 163 (223), respectively.

Since the widths of the opening portions 165 and 225 in the z-axis direction are slightly wider than the width of the side plate portion 435 in the z-axis direction, the side plate portion 435 can move in the x-axis direction without touching the edges of the opening portions 165 and 225, within the opening portions 165 and 225. The opening portions 165 and 225 are provided to regulate the movement amount of the main body portion 43 in the z-axis direction.

Since the widths of the opening portions 166 and 226 in the z-axis direction are slightly wider than the width of the side plate portion 436 in the z-axis direction, the side plate portion 436 can move in the x-axis direction without touching the edges of the opening portions 166 and 226, within the opening portions 166 and 226. The opening portions 166 and 226 are provided to regulate the movement amount of the main body portion 43 in the z-axis direction.

The widths of the opening portions 163 and 223 in the z-axis direction are the magnitudes that make it possible for the first pressing unit 431 to translate in the x-axis direction without touching the edges of the opening portions 163 and 223 in the z-axis direction.

The upper surface portion 437 is locked to the locking unit 227 from above by the weight of the main body portion 43, and movement in the x-axis direction is possible.

The second pressing unit 433 is biased in the x-axis positive direction by the biasing member 44.

Here, as illustrated in FIG. 6, the first locking unit 432 is locked to the surface of the first plate portion 221 below the opening portion 223 in the x-axis negative direction. The second locking unit 438 is locked to the first plate portion 221 close to the locking unit 227 at the inner edge of the opening portion 228.

The second pressing unit 433 is parallel to the flat surface portion 162 and protrudes in the x-axis positive direction from the flat surface portion 162.

When an external force greater than the biasing force of the biasing member 44 acts on the second pressing unit 433 in the x-axis negative direction, the biasing member 44 is compressed and the second pressing unit 433 moves in the x-axis negative direction. During the movement of the second pressing unit 433, the side plate portions 435 and 436 and the first pressing unit 431 move in the x-axis direction together with the second pressing unit 433.

The side plate portion 435 moves in the x-axis negative direction in a state where the movement in the z-axis direction is regulated by the opening portions 165 and 225, the side plate portion 436 moves in the x-axis negative direction in a state where the movement in the z-axis direction is regulated by the opening portions 166 and 226, and thus, the main body portion 43 can be translated in the x-axis direction as a whole.

While the main body portion 43 is translated, the first pressing unit 431 does not come into contact with the opening portions 163 and 223.

As illustrated in FIG. 6, the main body portion 43 and the biasing member 44 in the second correcting member 41 are installed similar to the main body portion 43 and the biasing member 44 in the first correcting member 40 except that the main body portion 43 and the biasing member 44 are installed at a position (at a position closer to the tray 15) relatively lower than the first correcting member 40 at the upper end portion of the support member 17.

The support member 17 penetrates the support member 17 in the thickness direction, and has the opening portions 163, 165, and 166 similar to the support member 16 except that the side plate portions 435 and 436 of the second correcting member 41 are guided to the position lower than the second correcting member 41.

Unlike the support member 16, the support member 17 does not include the opening portion 164. The first end portion 441 of the biasing member 44 in the second correcting member 41 directly abuts against the support member 17.

The support member 17 may be provided with an appropriate uneven portion that regulates the position of the biasing member 44 in the z-axis direction and the x-axis direction, instead of the opening portion 164 and the fixing member 22 that closes the opening portion 164 in the support member 16. For example, the support member 17 may include a semi-drilled hole recessed in the y-axis positive direction. The support member 17 may include a projection portion such as a semi-pulled shape or a hemisphere that protrudes in the y-axis negative direction and enters the inside of the first end portion 441 of the biasing member 44.

The upper surface portion 437 of the main body portion 43 of the second correcting member 41 is locked from above to the locking unit 172 formed in the upper end portion of the support member 17.

The opening portion 163 in the support member 16 is an example of an opening portion through which the first pressing unit is inserted to be translatable in the lateral direction. Here, the lateral direction is the x-axis positive direction.

The opening portion 163 in the support member 17 is an example of an opening portion through which the first pressing unit is inserted to be translatable in the lateral direction. Here, the lateral direction is the y-axis negative direction.

With reference to FIG. 8, an example of the positional relationship between the first correcting member 40 and the second correcting member 41 in the z-axis direction will be described.

The height in the z-axis direction is illustrated with reference to the paper feed position Hf indicated by the two-dot chain line. Any reference numeral starting with h, which represents the magnitude of the height, represents a positive value.

In the first correcting member 40, the upper end of the second pressing unit 433 is at the height of has from the paper feed position Hf to the upper side, and the lower end of the second pressing unit 433 is at the height of hba from the paper feed position Hf to the lower side.

In the first correcting member 40, the lower end of the first pressing unit 431 that protrudes from the flat surface portion 162 when an external force in the x-axis negative direction does not act on the main body portion 43 is at the height of hca from the paper feed position Hf to the lower side.

In the second correcting member 41, the upper end of the second pressing unit 433 is at the height of hab from the paper feed position Hf to the upper side, and the lower end of the second pressing unit 433 is at the height of hbb from the paper feed position Hf to the lower side.

In the second correcting member 41, the lower end of the first pressing unit 431 that protrudes from the flat surface portion 171 when an external force in the x-axis negative direction does not act on the main body portion 43 is at the height of hcb from the paper feed position Hf to the lower side.

In the embodiment, hbb is greater than hba and hcb is greater than hca.

The embodiment is an example in which the second pressing unit 433 of the second correcting member 41 is closer to the tray 15 than the second pressing unit 433 of the first correcting member 40 in the z-axis direction.

Since both hbb and hba are positive values, when the sheet St of the sheet bundle B rises to the paper feed position Hf, the sheet St receives the pressing force from the second pressing units 433 of both the first correcting member 40 and the second correcting member 41.

hbb may be equal to or greater than hca or less than hca.

For example, when hbb is equal to or greater than hca, the sheet St of the rising sheet bundle B is pressed by the first pressing unit 431 of the first correcting member 40 in a state of being pressed from the second pressing unit 433 of the second correcting member 41.

For example, when hbb is less than hca, the sheet St of the rising sheet bundle B is pressed by the second pressing unit 433 of the second correcting member 41 after being pressed by the first pressing units 431 of the second correcting member 41 and the first correcting member 40, and before being pressed by the second pressing unit 433 of the first correcting member 40.

In the example illustrated in FIG. 8, hbb is equal to or greater than hca.

In the embodiment, since the shape of each main body portion 43 of the first correcting member 40 and the second correcting member 41 is the same, haa is greater than hab. However, the shapes of each main body portion 43 may be different from each other. Here, hab can be made closer to the magnitude of haa, and for example, hab may be equal to haa.

Next, the operation of the sheet conveying device 1 will be described.

In order to supply the sheet S to the printer unit 105 by the sheet conveying device 1, as illustrated in FIG. 2, the drawer portion 24 is drawn out to the front side, and the sheet bundle B is stacked on the tray 15.

In the sheet bundle B, the outer peripheral portions Ba, Bb, Bc, and Bd are stacked at positions that respectively oppose the flat surface portion 162 of the support member 16, the flat surface portion 181 of the second guide member 18, the flat surface portion 191 (refer to FIG. 3) of the first guide member 19, and the flat surface portion 171 (refer to FIG. 4) of the support member 17.

The flat surface portion 181 defines a reference position for feeding the sheet S in the conveying direction F. In order to reduce the skew when feeding the sheet S, when starting to feed the sheet S, it is more preferable that the long side Sb of the sheet S abuts against the flat surface portion 181 to be parallel to the flat surface portion 181.

However, since the distance between the flat surface portions 181 and 171 is wider than the width of the sheet S in the lateral direction (direction along the short sides Sa and Sc) in order to make it easy to insert the sheet bundle B, there is a possibility that the outer peripheral portion Bb does not abut against the flat surface portion 181 when stacking the sheet bundle B.

The flat surface portion 191 defines a reference position for paper feeding on the left side when viewed in the conveying direction F, in a direction orthogonal to the conveying direction F within the horizontal surface. In order to reduce the skew when feeding the sheet S, when starting to feed the sheet S, it is more preferable that the short side Sc of the sheet S abuts against the flat surface portion 191 to be parallel to the flat surface portion 191.

However, since the distance between the flat surface portions 191 and 161 is wider than the width of the sheet S in the longitudinal direction (direction along the long sides Sb and Sd) in order to make it easy to insert the sheet bundle B, there is a possibility that the outer peripheral portion Bc does not abut against the flat surface portion 191 when stacking the sheet bundle B.

When the front cover 12 is closed, the driving of the drive motor 32 of the raising and lowering mechanism 30 is started, and the rising and falling frame 14 is raised. When the sheet detection sensor 316 detects that the sheet St of the sheet bundle B has reached the paper feed position Hf, the pickup roller 311 is lowered and the paper feeding operation of the sheet St is started.

According to the sheet conveying device 1, since the first correcting member 40 and the second correcting member 41 are provided, before the sheet St rises to the paper feed position Hf, it is possible to make at least each of the long side Sb and the short side Sc of the sheet St abuts against the flat surface portions 181 and 191 in a state of being parallel to the flat surface portions 181 and 191.

Since the basic operations of the first correcting member 40 and the second correcting member 41 are the same, first, the operation of the first correcting member 40 will be described.

Figure 9:
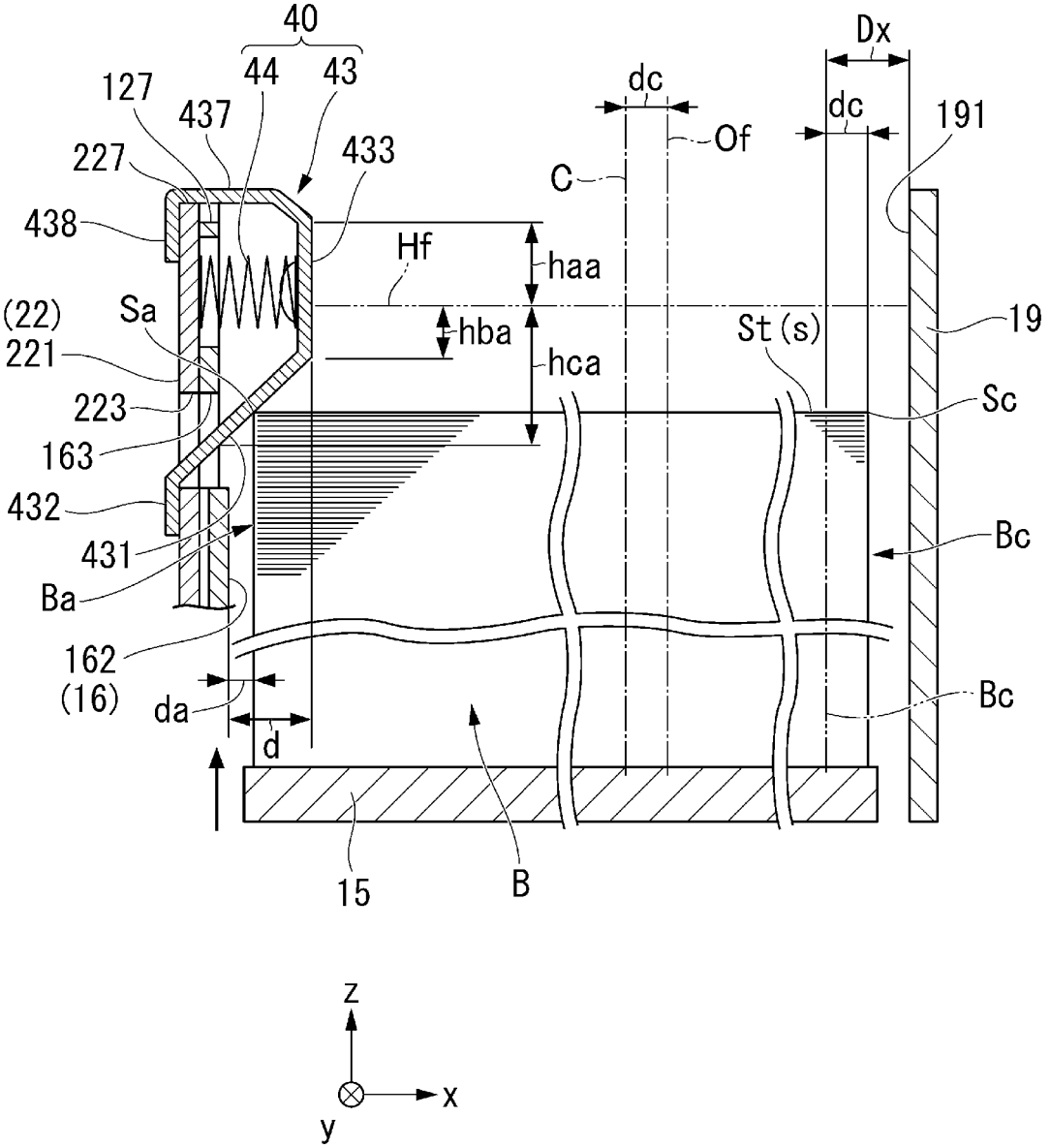
FIG. 9 is a schematic view of a section for describing an operation of the sheet conveying device.
Figure 10:
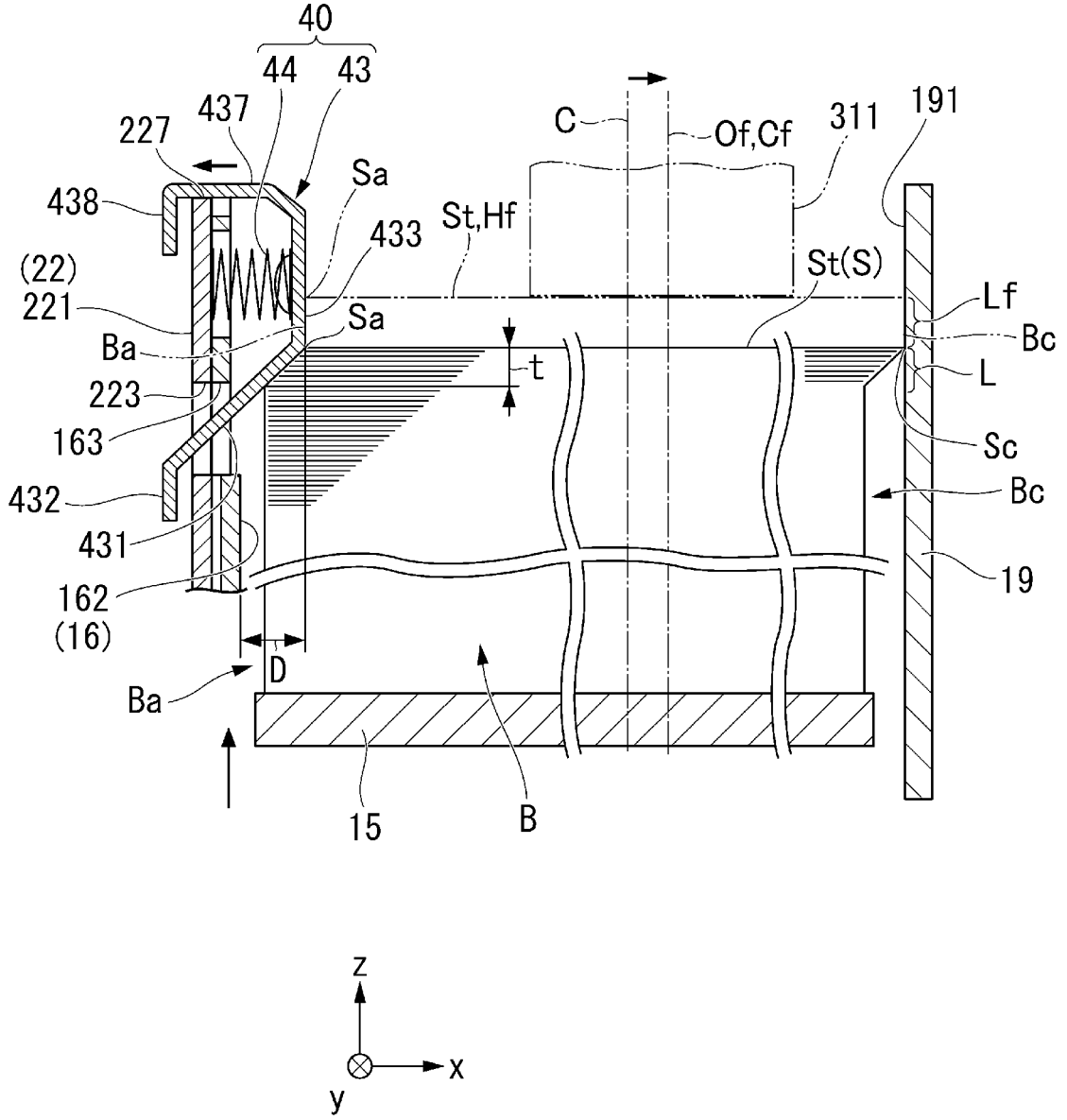
FIG. 10 is a schematic view of a section for describing an operation of the sheet conveying device.

FIGS. 9 and 10 are schematic views of a section for describing the operation of the sheet conveying device.

In the example illustrated in FIG. 9, in the sheet bundle B stacked on the tray 15, the gap between the outer peripheral portion Bc and the flat surface portion 191 is dc, and the gap between the outer peripheral portion Ba and the flat surface portion 162 is da.

In the main body portion 43 of the first correcting member 40, in a state where the sheet bundle B does not abut, the second locking unit 438 and the first locking unit 432 are locked to the first plate portion 221, and the second pressing unit 433 is positioned in the x-axis positive direction from the flat surface portion 162. For example, the distance between the flat surface portion 162 and the second pressing unit 433 is d. The magnitude of d is greater than a distance Dx between the outer peripheral portion Bc (refer to the two-dot chain line) and the flat surface portion 191 when the outer peripheral portion Ba abuts against the flat surface portion 162. Dx is equal to the sum of da and dc.

For example, d may be 1.1 mm.

A center axial line Of is a center axial line having a width in the x-axis direction of the sheet S when the short side Sc of the sheet S abuts against the flat surface portion 191 in parallel with the flat surface portion 191. The center axial line Of represents the center position of the sheet S in the x-axis direction when ideally feeding the sheet S.

A center axial line C is a center axial line having a width of the sheet bundle B in the x-axis direction in a state of being stacked on the tray 15. The center axial line C is deviated by dc in the x-axis negative direction with respect to the center axial line Of. The same applies to the center axial line having the width in the longitudinal direction of the sheet St on the uppermost surface of the sheet bundle B.

When the sheet St is fed in such state, the sheet St is fed while being biased by do in the x-axis negative direction with respect to the ideal paper feeding path, and lateral deviation occurs. When the image processing apparatus 100 does not include a lateral resist correction mechanism in a direction orthogonal to the conveying direction of the sheet St, the image formed on the sheet St is formed while being laterally deviated in the longitudinal direction of the sheet St.

When the outer peripheral portion Bc of the sheet bundle B has unevenness in the x-axis direction, the lateral deviation amount of the sheet S in the x-axis direction also varies depending on the unevenness amount.

When the tray 15 is raised, the sheet bundle B is also raised, and the short side Sa of the sheet St abuts against the first pressing unit 431 of the first correcting member 40. When the sheet bundle B rises, as illustrated in FIG. 10, an upper layer portion L of the sheet bundle B is pressed by the first pressing unit 431 biased by the biasing member 44, and moves in the x-axis positive direction along the inclination of the first pressing unit 431.

Along the inclination of the short side Sa of each sheet S included in the upper layer portion L, inclination is made in the diagonal direction facing in the x-axis positive direction as advancing in the z-axis positive direction. Each sheet S of the upper layer portion L slides with each other and moves in the x-axis direction.

In the first pressing unit 431, the biasing member 44 is compressed from the outer peripheral portion Ba in the upper layer portion L according to the reaction force. The reaction force has an x-axis negative direction component and a z-axis positive direction component. However, since the movement range of the side plate portions 435 and 436 of the main body portion 43 in the z-axis direction is regulated by the opening portions 165 and 225 and the opening portions 166 and 226, respectively, the movement in the z-axis direction rarely occurs. The entire main body portion 43 substantially translates in the x-axis negative direction.

The biasing force of the biasing member 44 is the magnitude that makes it possible to move the upper layer portion L in the x-axis positive direction against the reaction force component in the x-axis negative direction.

The movement amount of the upper layer portion L is determined by the balance between the biasing force of the biasing member 44 and the reaction force from the upper layer portion L.

When the upper layer portion L is sandwiched between the second pressing unit 433 and the flat surface portion 191, the biasing force of the biasing member 44 is the magnitude that makes the outer peripheral portion Ba abut against the second pressing unit 433 and the outer peripheral portion Bc abut against the flat surface portion 191, respectively.

When the biasing force of the biasing member 44 is extremely large, there is a possibility that the sheet S of the upper layer portion L is damaged by the external force that acts from the abutment portion with the main body portion 43. When the biasing force of the biasing member 44 is extremely large, there is a possibility that the upper layer portion L is curved to be projected upward and the sheet St is not be kept horizontal.

When the biasing force of the biasing member 44 is extremely small, the outer peripheral portion Bc of the upper layer portion L cannot abut against the flat surface portion 191.

For example, the biasing force of the biasing member 44 is not particularly limited as long as the sheet St of the upper layer portion L can abut against the flat surface portion 191 and the biasing force has the magnitude that does not damage the sheet S of the upper layer portion L. For example, the biasing force of the biasing member 44 is more preferably 1 N when being compressed by 0.5 mm.

As illustrated in FIG. 10, when the short side Sc of the sheet St abuts and the short side Sa reaches the end of the second pressing unit 433 in the z-axis negative direction, the second pressing unit 433 is transferred in the x-axis negative direction, and the distance from the flat surface portion 162 is D. D is equal to a value obtained by subtracting dc from d.

The first pressing unit 431 abuts against the upper layer portion L having a thickness of t. The magnitude of the thickness t of the upper layer portion L against which the first pressing unit 431 abuts is more preferably 1.5 mm or less in that an appropriate biasing force can be transmitted to the upper layer portion L and damage to the upper layer portion L can be prevented.

As the sheet S in the upper layer portion L becomes closer to the uppermost sheet St, the movement amount in the x-axis positive direction increases, and thus, each sheet S overlapping each other in the upper layer portion L move relative to each other in the x-axis direction and the adherence strength between the sheets deteriorates.

When the short side Sc of the sheet St abuts against the flat surface portion 191, the sheet St moves between the second pressing unit 433 and the flat surface portion 191 while being initially bent upward by the pressing force. When the upper layer portion L is further raised, the thickness of an upper layer portion Lf sandwiched between the second pressing unit 433 and the flat surface portion 191 becomes thicker, and thus, the bending of the upper layer portion Lf is eliminated by the own weight of the upper layer portion Lf.

Since the first pressing unit 431 and the second pressing unit 433 are smoothly bent and connected without a step, on the short side Sa of the sheet S that moves from the first pressing unit 431 to the second pressing unit 433, the occurrence of damage caused by the connection portion between the first pressing unit 431 and the second pressing unit 433 is prevented.

Both end portions of the second pressing unit 433 in the y-axis direction are connected to the side plate portions 435 and 436 that bend in the x-axis negative direction. Since the second pressing unit 433 and the side plate portions 435 and 436 are smoothly bent and connected without a step, the upper layer portion L is pressed from the second pressing unit 433, and on the short side Sa of the rising sheet S, the occurrence of damage caused by the peripheral edge of the second pressing unit 433 in the y-axis direction is prevented.

The upper layer portion Lf rises toward the paper feed position Hf while being pressed in the x-axis positive direction by the second pressing unit 433. The positions of each sheet S that forms the outer peripheral portion Bc of the upper layer portion Lf in the x-axis positive direction are corrected to be along the flat surface portion 191. The positions of each sheet S that forms the outer peripheral portion Ba of the upper layer portion Lf in the x-axis negative direction are corrected to be along the second pressing unit 433. As for the upper layer portion Lf as a whole, the center axial line Cf having the width in the x-axis direction is moved to a position that matches the center axial line Of.

When the sheet St of the upper layer portion Lf reaches the paper feed position Hf, it is detected by the sheet detection sensor 316. When the sheet detection sensor 316 detects that the sheet St has reached the paper feed position Hf, the drive motor 32 is stopped and the rise of the tray 15 is stopped.

The sheet St in the upper layer portion Lf is arranged at the paper feed position Hf in a state where the center axial line Cf in the x-axis positive direction matches the center axial line Of.

For example, when a paper feed start signal is generated in response to the operation of the operation unit 101, the pickup roller 311, the paper feed roller 312, and the separation roller 313 are driven to start to feed the sheet St toward the printer unit 105.

When the paper feeding of the sheet St is completed, the tray 15 rises, the sheet S below the sheet St sequentially rises to the paper feed position Hf, and the paper feeding is continued.

The sheet St fed to the printer unit 105 is discharged after image formation or image processing is performed in the printer unit 105.

In such a paper feeding operation, the first correcting member 40 forms the upper layer portions L and Lf by pressing the outer peripheral portion Ba of the sheet bundle B, which sequentially rises from below to be close to the first pressing unit 431, in the x-axis positive direction which is the lateral direction toward the inside from the outside of sheet S.

The paper feeding operation in relation to the first correcting member 40 has been described above. In the outer peripheral portions Bb and Bd of the sheet S, substantially the same operation proceeds between the second correcting member 41 and the flat surface portion 181.

The second correcting member 41 forms the upper layer portions L and Lf by pressing the outer peripheral portion Bd of the sheet bundle B, which sequentially rises from below to be close to the first pressing unit 431, in the y-axis negative direction which is the lateral direction toward the inside from the outside of sheet S. In the upper layer portion Lf formed by the second correcting member 41, the outer peripheral portion Ba abuts against the flat surface portion 181 of the second guide member 18.

The sheet S abuts against the flat surface portions 191 and 181 in two directions intersecting each other by the first correcting member 40 and the second correcting member 41, and thus, before rising to the paper feed position Hf, the short side Sc and the long side Sb respectively abut against the flat surface portions 191 and 181, and the posture within the xy plane is corrected.

Since the second correcting member 41 is provided at a position closer to the tray 15 than the first correcting member 40, before the short side Sa abuts against the first pressing unit 431 of the first correcting member 40, the long side Sd of the sheet St abuts against the first pressing unit 431 of the second correcting member 41. Similarly, before the upper layer portion L is sandwiched between the first correcting member 40 and the flat surface portion 191 and the upper layer portion Lf is formed, the upper layer portion Lf is formed while the upper layer portion L is sandwiched between the second correcting member 41 and the flat surface portion 181.

Hereinafter, the action of the combination of the first correcting member 40 and the second correcting member 41 is described using an example in which hbb is greater than hba and hbb is equal to or greater than hca as illustrated in FIG. 8.

Figure 11:
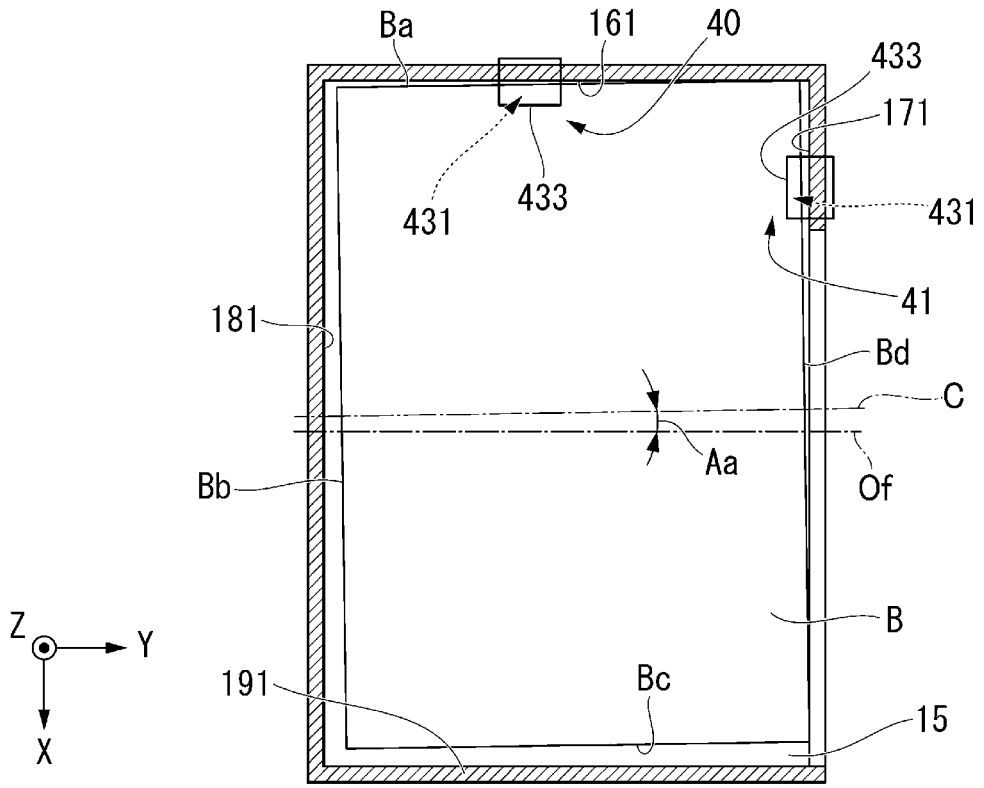
FIG. 11 is a schematic view in a plan view for describing an operation of the sheet conveying device.
Figure 12:
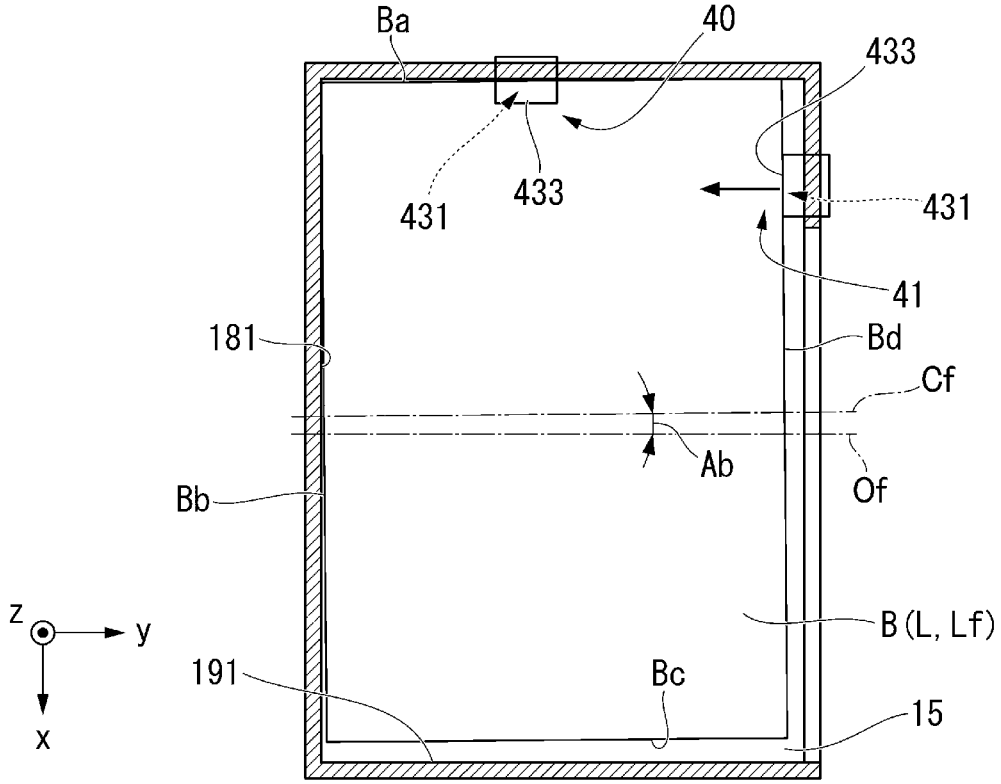
FIG. 12 is a schematic view in a plan view for describing an operation of the sheet conveying device.
Figure 13:
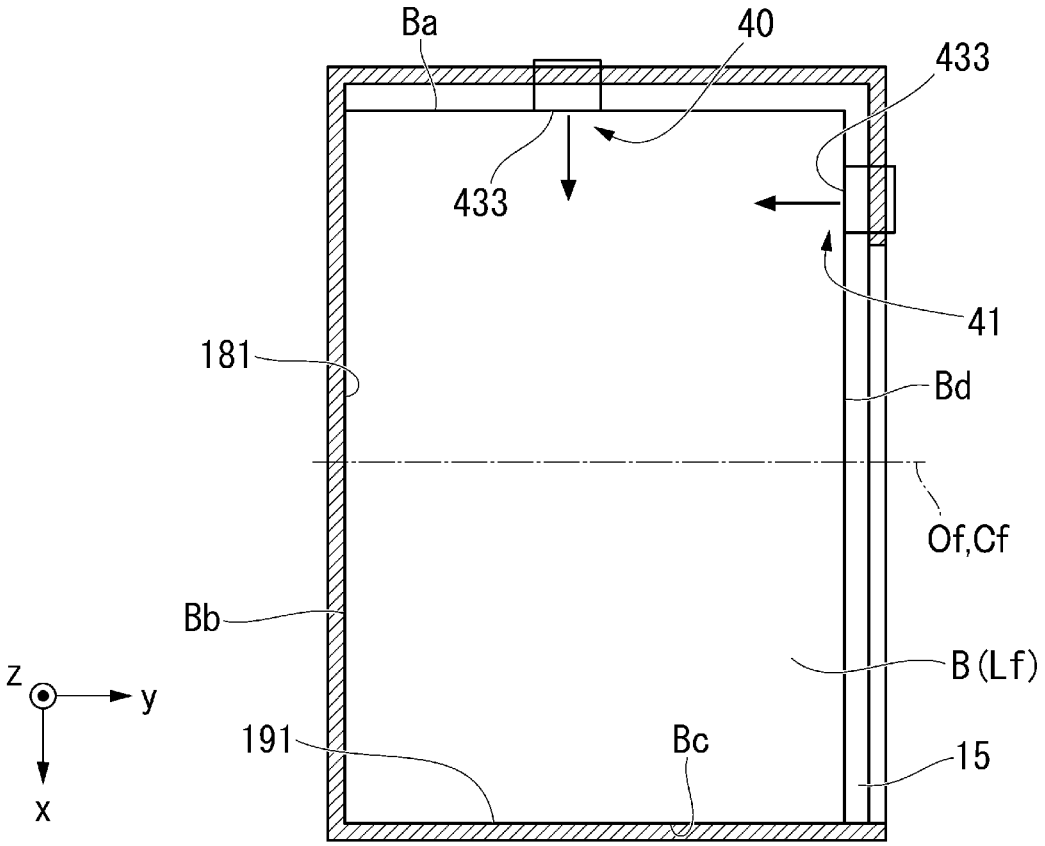
FIG. 13 is a schematic view in a plan view for describing an operation of the sheet conveying device.

FIGS. 11 to 13 are schematic views in a plan view for describing the operation of the sheet conveying device.

FIG. 11 schematically illustrates an arrangement example of the sheet bundle B before the start of rising.

In the arrangement example, in a plane view, the outer peripheral portion Bb is separated from the flat surface portion 181 in a state of being non-parallel to the flat surface portion 181. In a plane view, the outer peripheral portion Bd is separated from the flat surface portion 191 in a state of being non-parallel to the flat surface portion 191.

The center axial line C of the outer peripheral portion Bb is inclined in the x-axis negative direction from the center axial line Of, which is the direction in the x-axis positive direction as advancing in the y-axis negative direction. The magnitude of the inclination angle of the center axial line C with respect to the center axial line Of is Aa measured from the center axial line Of in a counterclockwise direction in the drawing.

When the tray 15 starts to rise, the outer peripheral portion Bd of the sheet bundle B abuts against the first pressing unit 431 of the second correcting member 41. Here, the outer peripheral portion Ba and the first correcting member 40 does not abut against each other.

When the tray 15 further rises, as illustrated in FIG. 12, the first pressing unit 431 and the second pressing unit 433 of the second correcting member 41 abut against the outer peripheral portion Bd in this order.

While the outer peripheral portion Bc abuts against the first pressing unit 431, the upper layer portion L is pressed from the first pressing unit 431 in the y-axis negative direction and moves in the y-axis negative direction.

While the outer peripheral portion Bd abuts against the second pressing unit 433, a pressing force acts on the outer peripheral portion Bd from the second pressing unit 433, and the upper layer portion Lf sandwiched between the flat surface portion 181 and the second pressing unit 433 is formed. Since the outer peripheral portion Bb of the upper layer portion Lf is pressed in the y-axis negative direction by the second pressing unit 433, the outer peripheral portion Bb follows the flat surface portion 181 that opposes the second correcting member 41, and the inclination angle with respect to the center axial line Of decreases from Aa to Ab.

The outer peripheral portion Bb is pressed against the flat surface portion 181 at the part that opposes the second correcting member 41, and approaches the flat surface portion 181 at the part separated from the second correcting member 41 in the x-axis positive direction.

When the tray 15 rises, in a state where the second pressing unit 433 of the second correcting member 41 presses the outer peripheral portion Bd, the outer peripheral portion Ba abuts against the first pressing unit 431 and the second pressing unit 433 of the first correcting member 40 in this order.

As described with reference to FIGS. 9 and 10, while the outer peripheral portion Ba abuts against the first pressing unit 431 of the first correcting member 40, the upper layer portion L is pressed from the first pressing unit 431 in the x-axis positive direction, and moves in the x-axis positive direction.

While the outer peripheral portion Ba abuts against the second pressing unit 433 of the first correcting member 40, the upper layer portion Lf sandwiched between the flat surface portion 191 and the second pressing unit 433 is formed.

Since the first correcting member 40 is arranged in the intermediate portion of the outer peripheral portion Ba in the y-axis direction, the upper layer portion Lf can be pressed in a well-balanced manner in the lateral direction of the sheet S. The outer peripheral portion Bd of the upper layer portion Lf is pressed against the flat surface portion 191 substantially as a whole. Since the position of the outer peripheral portion Bd is corrected along the flat surface portion 191, the inclination angle Ab is also corrected.

As illustrated in FIG. 13, the entire outer peripheral portion Bb of the upper layer portion Lf is pressed against the flat surface portion 181 and the entire outer peripheral portion Bc of the upper layer portion Lf is pressed against the flat surface portion 191. The center axial line Cf of the upper layer portion Lf matches the center axial line Of.

As such, the position of the upper layer portion Lf of the sheet bundle B including the sheet St is aligned with the reference position of the paper feeding by the flat surface portions 181 and 191.

The sheet bundle B below the upper layer portion Lf is deviated from the reference position for the paper feeding, but as the paper feeding of the sheet S progresses, the similar upper layer portion Lf is formed by the lower sheet S, and before starting the paper feeding, each sheet S is aligned with the reference position for the paper feeding.

In the embodiment, since the second correcting member 41 is closer to the tray 15 than the first correcting member 40, the upper layer portion L of the sheet bundle B pressed by the second correcting member 41 is first pressed against the flat surface portion 181 as the tray 15 rises. Next, the upper layer portion L of the sheet bundle B is pressed by the first correcting member 40 and pressed against the flat surface portion 191.

The width of the flat surface portion 181 in the x-axis direction is wider than the width of the flat surface portion 191 in the y-axis direction, and thus, compared to a case where the sheet S is first pressed against the flat surface portion 191, the posture of the seat S is more reliably corrected.

An experiment about how much the paper feeding performance can be improved was conducted by aligning the sheet S with the reference position of the paper feeding at the paper feed position Hf by the first correcting member 40 and the second correcting member 41.

In the experiment, the sheet bundle B in which the A4-sized sheets S are stacked was accommodated in the sheet conveying device 1, and the variation of the gradient of the short side Sc of the sheet S when feeding the sheet was measured as the variation of the position of the back end point in the x-axis direction with respect to the position of the distal end point in the x-axis direction of the short side Sc in the conveying direction F. The distal endpoint of the short side Sc is the vertex of the angle formed by the short side Sc and the long side Sb. The back end point of the short side Sc is the vertex of the angle formed by the short side Sc and the long side Sd. When the positions of the distal end point and the back endpoint of the short side Sc in the x-axis direction are respectively expressed by xf and xr with reference to the flat surface portion 191, (xr−xf) is the back end lateral deviation amount that expresses the lateral deviation of the back end point with respect to the distal end point.

The gradient of the short side Sc with respect to the flat surface portion 191 is expressed by $\tan^{-1}\{(xr-xf)/wc\}$. Here, we is the length of Sc, and when the sheet S is A4-sized, the length is 210 mm. The gradient of the short side Sc expresses the skew amount of the side end of the sheet S in the conveying direction.

In the experiment, the pressing force of the biasing member 44 was set to 1 N when the biasing member 44 was compressed by 0.5 mm such that the sheet S was not damaged. The thickness t (refer to FIG. 10) of the upper layer portion L was 1.5 mm.

180 sheets S were fed, the back end lateral deviation amount when feeding the sheet S was measured, and the standard deviation σ of the back end lateral deviation amount was obtained. When ±3σ is defined as the variation in the back end lateral deviation amount, the variation in the back end lateral deviation amount is ±0.98 mm. When the variation in the back end deviation amount was converted into the variation in the gradient of the short side Sc, the variation was ±0.27 degrees.

For comparison, when the same experiment was performed with the sheet conveying device of the comparative example having no first correcting member 40 and the second correcting member 41, the variation of the back end lateral deviation amount was ±1.16 mm. The variation in the gradient of the short side Sc was ±0.32 degrees.

In the sheet conveying device 1 of the embodiment having the first correcting member 40 and the second correcting member 41, the variation of the skew which is the gradient of the side end of the seat S in the conveying direction was improved by approximately 15.5%.

The skew of the sheet S in the embodiment is reduced by feeding the sheet S in a state where the short side Sc is pressed against the flat surface portion 191. The reduction in the variation in the back end lateral deviation amount corresponds to the reduction in the average lateral deviation amount in the x-axis direction of the sheet S.

As described above, since the sheet conveying device 1 of the embodiment includes the first correcting member 40 and the second correcting member 41, before each sheet S of the sheet bundle B stacked on the tray 15 reaches the paper feed position Hf, the position and the posture of the sheet S are corrected along the flat surface portion 181 which is the reference position for the paper feeding in the conveying direction F, and the flat surface portion 191 which is the reference position for the paper feeding in the direction intersecting the conveying direction F.

Regarding the sheet S fed in such state, the lateral deviation and the skew during the paper feeding is reduced, and thus the conveying performance of the printer unit 105 after the paper feeding is improved. When an image is formed by the image processing apparatus 100, the lateral deviation and the skew of the image are prevented, and the image quality is improved.

According to at least one embodiment described above, the sheet conveying device includes the correcting member that corrects the position of the upper layer portion in the lateral direction intersecting the thickness direction toward the inside from the outside of the sheet bundle by pressing the upper layer portion of the outer peripheral portion of the sheet bundle from the outside as relatively approaching the sheet bundle on the tray in the thickness direction, and thus, it is possible to provide a sheet conveying device that can prevent the variation in the posture of the sheet during the paper feeding.

Hereinafter, a modification example of the above-described embodiment will be described.

A first modification example of the correcting member will be described focusing on the points different from the embodiment.

Figure 14:
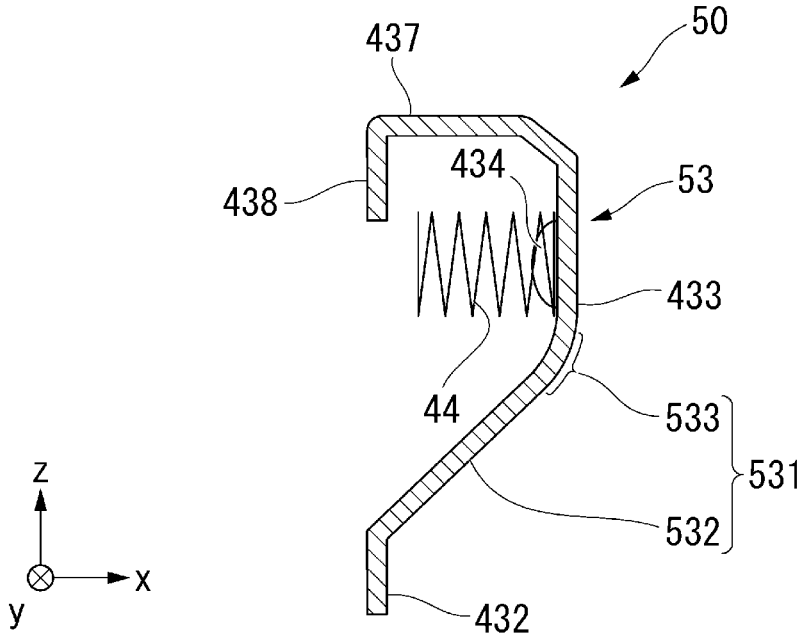
FIG. 14 is a schematic view of a section for describing a first modification example of a correcting member that can be used for the sheet conveying device.

FIG. 14 is a schematic view of a section for describing the first modification example of the correcting member that can be used for the sheet conveying device.

As illustrated in FIG. 14, the correcting member 50 of the modification example has a main body portion 53 instead of the main body portion 43 of the first correcting member 40.

The main body portion 53 is the same as the main body portion 43 except that a first pressing unit 531 is provided instead of the first pressing unit 431 of the main body portion 43.

The first pressing unit 531 includes an inclined portion 532 and a curved portion 533 in this order from the first locking unit 432 toward the second pressing unit 433.

The inclined portion 532 is a flat plate portion that is inclined similar to the first pressing unit 431 from the end of the first locking unit 432 in the z-axis positive direction toward the second pressing unit 433, similarly to the first pressing unit 431.

The curved portion 533 is curved in an arc shape when viewed in the y-axis positive direction from the end of the inclined portion 532 in the z-axis positive direction toward the z-axis positive direction.

The curved portion 533 is smoothly connected respectively to the inclined portion 532 and the second pressing unit 433 without any step.

The correcting member 50 can be used instead of at least one of the first correcting member 40 and the second correcting member 41 of the embodiment.

According to the correcting member 50 of the modification example, the inclination of the first pressing unit 531 continuously and gradually changes from the inclination of the inclined portion 532 toward the z-axis positive direction in the curved portion 533, and thus, the outer peripheral portion of the sheet bundle B can be pressed more smoothly in the lateral direction as the sheet bundle B rises.

According to the correcting member 50, the sheet bundle B can be moved from the first pressing unit 531 to the second pressing unit 433 more smoothly than in the embodiment, and the damage preventing effect on the sheet S is improved.

A second modification example of the correcting member will be described focusing on the points different from the embodiment.

Figure 15:
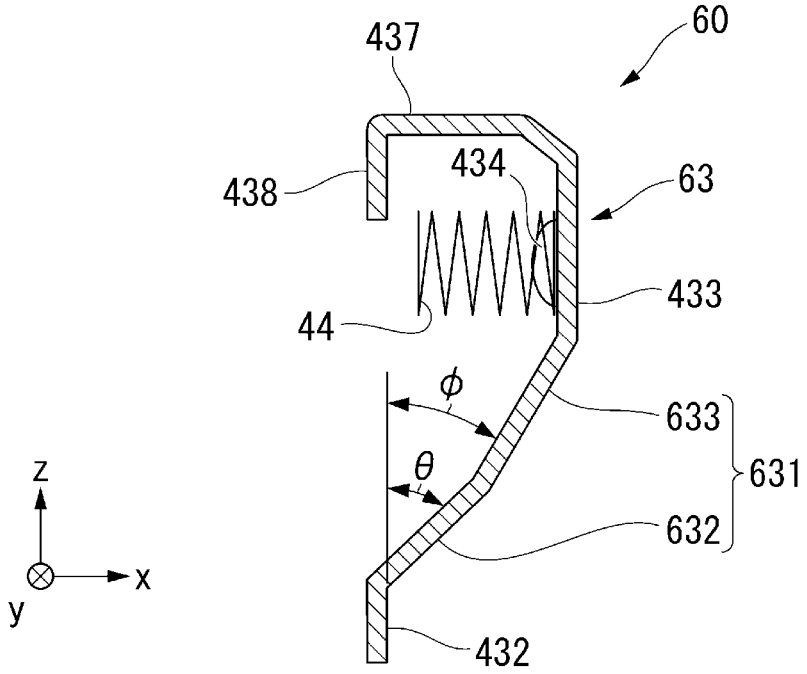
FIG. 15 is a schematic view of a section for describing a second modification example of a correcting member that can be used for the sheet conveying device.

FIG. 15 is a schematic view of a section for describing the second modification example of the correcting member that can be used for the sheet conveying device.

As illustrated in FIG. 15, the correcting member 60 of the modification example has a main body portion 63 instead of the main body portion 43 of the first correcting member 40.

The main body portion 63 is the same as the main body portion 43 except that a first pressing unit 631 is provided instead of the first pressing unit 431 of the main body portion 43.

The first pressing unit 631 includes a first inclined portion 632 and a second inclined portion 633 in this order from the first locking unit 432 toward the second pressing unit 433.

The first inclined portion 632 is a flat plate portion that is inclined similar to the first pressing unit 431 from the end of the first locking unit 432 in the z-axis positive direction toward the second pressing unit 433, similarly to the first pressing unit 431.

In the second inclined portion 633, the inclination with respect to the yz plane is more shallowly inclined than the first inclined portion 632 from the end of the first inclined portion 632 in the z-axis positive direction toward the end of the second pressing unit 433 in the z-axis negative direction. For example, when the inclination angle of the first inclined portion 632 with respect to the yz plane is an acute angle $\theta$ and the inclination angle of the second inclined portion 633 with respect to the yz plane is an acute angle $\phi$, the magnitude of the acute angle $\phi$ is smaller than the magnitude of the acute angle $\theta$.

The second inclined portion 633 is smoothly connected respectively to the first inclined portion 632 and the second pressing unit 433 without any step.

According to the correcting member 60 of the modification example, the inclination of the first pressing unit 631 with respect to the yz plane changes in two stages at the first inclined portion 632 and the second inclined portion 633, respectively, and approaches in the z-axis positive direction, and thus, as the sheet bundle B rises, the outer peripheral portion of the sheet bundle B can be pressed more smoothly in the lateral direction.

According to the correcting member 60, the sheet bundle B can be moved from the first pressing unit 631 to the second pressing unit 433 more smoothly than in the embodiment, and the damage preventing effect on the sheet S is improved.

In the above-described embodiment, a case was described where the positions of the first correcting member 40 and the second correcting member 41 in the z-axis direction are fixed to the support members 16 and 17, respectively, and the tray 15 approaches toward the first correcting member 40 and the second correcting member 41 by the raising and lowering mechanism 30.

However, the correcting member and the tray may be relatively movable to be relatively close to each other in the thickness direction of the sheet. For example, the tray may be stationary and the correcting member may move toward the tray, or both the tray and the correcting member may move and approach each other. In order to keep the uppermost sheet of the sheet bundle at the convey position, a moving mechanism that moves both the tray and the correcting member may be provided.

In the above-described embodiment, the correcting member was described in which the main body portion including the first pressing unit and the second pressing unit and the biasing member are separate members. However, the first pressing unit, the second pressing unit, and the biasing member may be integrated. For example, as a biasing member, a plate spring portion extending from the part of the second pressing unit that does not interfere with the pressing of the sheet bundle toward the support member may be provided. Examples of the part that does not interfere with the pressing include, in the embodiment, a part of the side plate portions 435 and 436 and the upper surface portion 437, the surface of the second pressing unit 433 in the x-axis negative direction, and the like.

In the above-described embodiment, an example was described in which the first pressing unit of the correcting member translates together with the second pressing unit to maintain the inclination of the first pressing unit during movement. However, the inclination of the first pressing unit may change by deforming due to the reaction force from the sheet bundle as long as the inclination direction does not change significantly.

In the above-described embodiment, an example was described in which the first pressing unit of the correcting member translates together with the second pressing unit to maintain the inclination of the first pressing unit during movement. However, the lower end portion of the first pressing unit may be supported or fixed to the support member not to move in the moving direction of the second pressing unit. Here, the inclination of the first pressing unit may change according to the reaction force from the sheet bundle.

In the above-described embodiment, an example was described in which the second correcting member that presses the outer peripheral portion of the sheet bundle in the second lateral direction which is the same as the conveying direction of the lateral directions is closer to the tray than the first correcting member that presses the outer peripheral portion of the sheet bundle in the first lateral direction intersecting the conveying direction of the lateral directions. In the embodiment, the main body portion 43 of the first correcting member 40 and the main body portion 43 of the second correcting member 41 have the same shape, and thus, both the second pressing unit 433 and the first pressing unit 431 of the second correcting member 41 are at a position closer to the tray 15 than the second pressing unit 433 and the first pressing unit 431 of the first correcting member 40.

However, when the first correcting member and the second correcting member press the sheet bundle in the first lateral direction and the second lateral direction at the paper feed position, the first correcting member and the second correcting member may be arranged at the same height, or the first correcting member may be closer to the tray.

In the above-described embodiment, an example was described where the first correcting member and the second correcting member are provided one by one respectively. However, two or more of at least one of the first correcting member and the second correcting member may be provided. Here, it becomes easy to correct the position of the large-sized sheet S.

In the above-described embodiment, an example was described where the first correcting member and the second correcting member are provided one by one respectively. However, one of the first correcting member and the second correcting member may be omitted.

For example, when stacking the sheet bundle, and when it is possible to arrange the outer peripheral portion in one of the conveying direction and the direction intersecting the conveying direction by pressing the outer peripheral portion against the guide member, the correcting member that presses the outer peripheral portion of the sheet bundle only in the direction in which it is difficult to press the outer peripheral portion against the guide member may be provided.

In the above-described embodiment, an example was described in which, regarding the size of the sheet bundle, the length in the width direction orthogonal to the conveying direction is longer than the width of the conveying direction. However, the sheet conveying device may be able to feed the sheets from the sheet bundle of which the length in the width direction orthogonal to the conveying direction is equal to or less than the width in the conveying direction.

In the above-described embodiment, an example of a case was described where the image processing apparatus is a multi-function peripheral. However, the image processing apparatus is not limited to the multi-function peripheral. For example, the image processing apparatus may be a printer, a fax machine, a copier, or the like.

The sheet conveying device of the embodiment may be used by being connected to a sheet processing apparatus other than the image processing apparatus. For example, as a sheet processing apparatus in which the sheet conveying device of the embodiment can be used, a document conveying apparatus and the like can be mentioned.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet conveying device, comprising:

a tray for stacking a sheet bundle in which a plurality of sheets are overlapped in a thickness direction of the sheet bundle; and a correcting member that moves relative to the tray in the thickness direction, abuts against an upper layer portion of an outer peripheral portion of the sheet bundle on the tray, presses the upper layer portion from an outside of the sheet bundle after abutting, and corrects a position of the upper layer portion in a lateral direction intersecting the thickness direction toward an inside from the outside of the sheet bundle, wherein the correcting member comprises a first correcting member and a second correcting member, the first correcting member corrects the position of the upper layer portion in a first lateral direction orthogonal to a conveying direction in which the sheet is conveyed, of the lateral directions, and the second correcting member corrects the position of the upper layer portion in a second lateral direction in the same direction as the conveying direction, of the lateral directions.

2. The sheet conveying device according to claim 1, wherein the correcting member comprises a first pressing component and a second pressing component in this order from the tray in the thickness direction, the first pressing component is gradually inclined in the lateral direction as approaching the second pressing component in the thickness direction from an end portion toward the tray, and the second pressing component is connected to the end portion of the first pressing component in the lateral direction and extends in the thickness direction.

3. The sheet conveying device according to claim 2, wherein the correcting member further comprises a biasing member that biases the second pressing component in the lateral direction.

4. The sheet conveying device according to claim 1, wherein the first correcting member and the second correcting member respectively comprise a first pressing component and a second pressing component.

5. The sheet conveying device according to claim 2, wherein the first correcting member and the second correcting member respectively comprise the first pressing component and the second pressing component, the first correcting member corrects the position of the upper layer portion in a first lateral direction orthogonal to a conveying direction in which the sheet is conveyed, of the lateral directions, and the second correcting member corrects the position of the upper layer portion in a second lateral direction in the same direction as the conveying direction, of the lateral directions.

6. The sheet conveying device according to claim 5, wherein the second pressing component of the second correcting member is closer to the tray than the second pressing component of the first correcting member in the thickness direction.

7. The sheet conveying device according to claim 2, further comprising:

a first guide member; and a second guide member, wherein the correcting member comprises a first correcting member that comprises the first pressing component and the second pressing component and corrects the position of the upper layer portion in a first lateral direction of the lateral directions, and a second correcting member that comprises the first pressing component and the second pressing component and corrects the position of the upper layer portion in a second lateral direction orthogonal to the first lateral direction of the lateral directions, the first guide member on an opposite side of the first correcting member across the sheet bundle, and abuts against the outer peripheral portion of the sheet bundle in an opposite direction of the first lateral direction, the second guide member has a width wider than a width of the first guide member in the lateral direction, is the second guide member on an opposite side of the second correcting member across the sheet bundle, and abuts against the outer peripheral portion of the sheet bundle from an opposite direction of the second lateral direction, and the first pressing component of the second correcting member is closer to the tray than the first pressing component of the first correcting member in the thickness direction.

8. The sheet conveying device according to claim 3, further comprising:

a support member that supports the correcting member such that the second pressing component of the correcting member is positioned at a convey position in the thickness direction where the uppermost sheet of the sheet bundle is conveyed, wherein the biasing member comprises a compression coil spring provided between the support member and the second pressing component.

9. The sheet conveying device according to claim 8, wherein the support member comprises an abutment portion capable of abutting the outer peripheral portion of the sheet bundle and aligning the position of the outer peripheral portion in the lateral direction, and an opening portion through which the first pressing component is inserted to be translatable in the lateral direction, the second pressing component is capable of advancing or retreating in the lateral direction from the abutment portion, and the first pressing component moves in the lateral direction together with the second pressing component.

10. A sheet conveying method, comprising:

moving a correcting member relative to a tray for stacking a sheet bundle in which a plurality of sheets are overlapped in a thickness direction of the sheet bundle in the thickness direction;

abutting the correcting member against an upper layer portion of an outer peripheral portion of the sheet bundle on the tray;

pressing the upper layer portion from an outside of the sheet bundle by the correcting member; and correcting a position of the upper layer portion in a lateral direction intersecting the thickness direction toward an inside from the outside of the sheet bundle, wherein correcting comprises:

correcting the position of the upper layer portion in a first lateral direction orthogonal to a conveying direction in which the sheet is conveyed, of the lateral directions; and correcting the position of the upper layer portion in a second lateral direction in the same direction as the conveying direction, of the lateral directions.

11. The sheet conveying method according to claim 10, further comprising:

abutting a guide member on an opposite side of the correcting member across the sheet bundle against the outer peripheral portion of the sheet bundle in the opposite direction of the lateral direction.

12. The sheet conveying method according to claim 11, further comprising:

biasing the correcting member in the lateral direction.

* * * * *